US009766034B2

(12) United States Patent
Huang et al.

(10) Patent No.: US 9,766,034 B2
(45) **Date of Patent: *Sep. 19, 2017**

(54) BOLT-ON COLLAPSIBLE STOCK ASSEMBLY FOR A FIREARM

(71) Applicants: George Huang, Henderson, NV (US); Jeffrey S. Cross, Lexington, TN (US)

(72) Inventors: George Huang, Henderson, NV (US); Jeffrey S. Cross, Lexington, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/197,890

(22) Filed: Jun. 30, 2016

(65) Prior Publication Data

US 2016/0305738 A1 Oct. 20, 2016

Related U.S. Application Data

(63) Continuation-in-part of application No. 14/639,913, filed on Mar. 5, 2015, now Pat. No. 9,574,846.

(51) Int. Cl.

| | |
|---|---|
| ***F41C 23/14*** | (2006.01) |
| ***F41C 23/04*** | (2006.01) |
| ***F41C 23/20*** | (2006.01) |
| *F41A 3/66* | (2006.01) |

(52) U.S. Cl.

CPC ..... *F41C 23/04* (2013.01); *F41C 23/20* (2013.01); *F41A 3/66* (2013.01)

(58) Field of Classification Search

CPC ..... F41C 23/14; F41C 23/06; F41C 23/04; F41A 3/84; F41A 5/18

USPC ..... 42/71.01–74; 89/191.01

See application file for complete search history.

(56) References Cited

U.S. PATENT DOCUMENTS

| | | | | |
|---|---|---|---|---|
| 3,386,336 A * | 6/1968 | Roy | F41A 3/72 | 42/75.02 |
| 3,688,641 A * | 9/1972 | Curtis | F41A 3/72 | 89/189 |
| 3,960,053 A * | 6/1976 | Conley | F41A 3/70 | 89/149 |
| 4,416,186 A * | 11/1983 | Sullivan | F41A 3/26 | 89/198 |

(Continued)

OTHER PUBLICATIONS https://troyind.com/products/pdw-stock-kit-fde.

(Continued)

*Primary Examiner* — Michael David

(74) *Attorney, Agent, or Firm* — Shaddock Law Group, PC

(57) ABSTRACT

A receiver having a stock connector component having a stock connector aperture formed therethrough; two rod apertures formed through the stock connector component, wherein each extension rod aperture is formed so as to slidably receive an extension rod extending from a stock, such that each extension rod is slidably movable within one of the rod apertures; wherein each extension rod comprises a rod channel and two or more rod dimples/detents formed along the rod channel; and a latch that is movable between an engaged position and a disengaged position, wherein when the latch is in the engaged position, a protrusion portion urges latch elements into the rod apertures a distance that seats the latch elements into the rod dimples/detents, and wherein when the latch is in the disengaged position, the protrusion portion allows the latch elements to retract from the rod dimples/detents and into the rod channels.

20 Claims, 23 Drawing Sheets

(56) References Cited

U.S. PATENT DOCUMENTS

| | | | | |
|---|---|---|---|---|
| 8,051,593 | B2 * | 11/2011 | Vesligai | F41C 23/04 42/73 |
| 8,844,185 | B2 * | 9/2014 | Jarboe | F41C 23/04 42/73 |
| 8,850,735 | B2 * | 10/2014 | Kenney | F41A 3/66 42/106 |
| 8,950,097 | B2 * | 2/2015 | Sugg | F41A 3/68 42/16 |
| 9,228,795 | B1 * | 1/2016 | Kielsmeier | F41C 23/14 |
| 9,347,739 | B2 * | 5/2016 | Gomirato | F41C 23/04 |
| 9,404,708 | B1 * | 8/2016 | Chow | F41C 23/06 |
| 2007/0261284 | A1 * | 11/2007 | Keng | F41C 23/04 42/73 |
| 2010/0275489 | A1 * | 11/2010 | Cabahug | F41C 23/22 42/71.01 |
| 2010/0307042 | A1 * | 12/2010 | Jarboe | F41A 3/18 42/6 |
| 2011/0283585 | A1 * | 11/2011 | Cabahug | F41C 23/22 42/73 |
| 2012/0151813 | A1 * | 6/2012 | Brown | F41C 7/00 42/73 |
| 2014/0190056 | A1 * | 7/2014 | Troy | F41C 23/14 42/71.01 |
| 2014/0260946 | A1 * | 9/2014 | Gomez | F41A 5/18 89/191.01 |
| 2016/0033219 | A1 * | 2/2016 | Meier | F41A 3/66 89/191.01 |
| 2016/0187099 | A1 * | 6/2016 | Cottle | F41C 23/14 42/73 |

OTHER PUBLICATIONS http://www.thetruthaboutguns.com/2014/10/jeremy-s/new-product-troys-500-ar-15-pdw-stock-kit/.

http://www.brownells.com/rifle-parts/stock-parts/buttstocks/ar-15-compact-carbine-stock-prod71258.aspx.

http://www.neaginc.com/3_accessories.html.

http://www.midwayusa.com/product/982877/nordic-components-compact-retractable-stock-for-ar-15-dedicated-22-long-rifle-conversions-black.

http://www.romeotangobravo.net/2011/10/aac-honey-badger.html.

* cited by examiner

FIG. 7
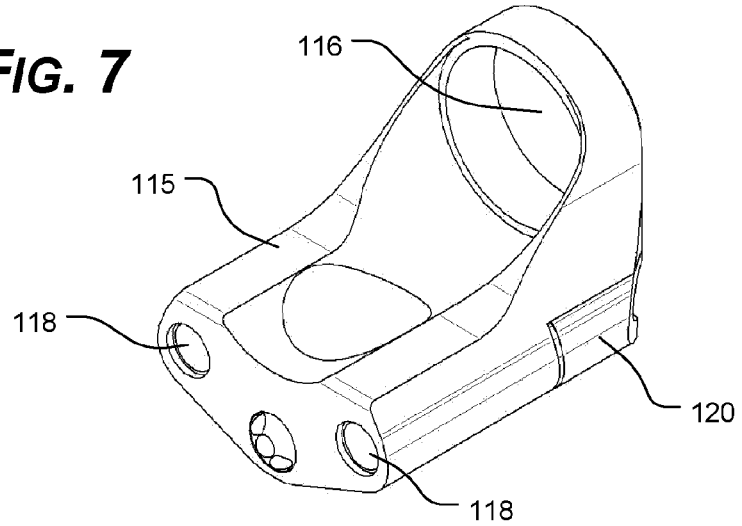
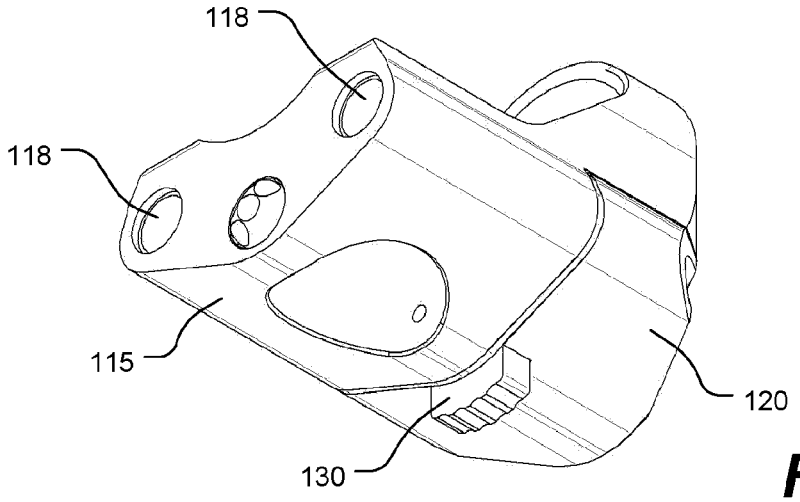
FIG. 8

FIG. 11
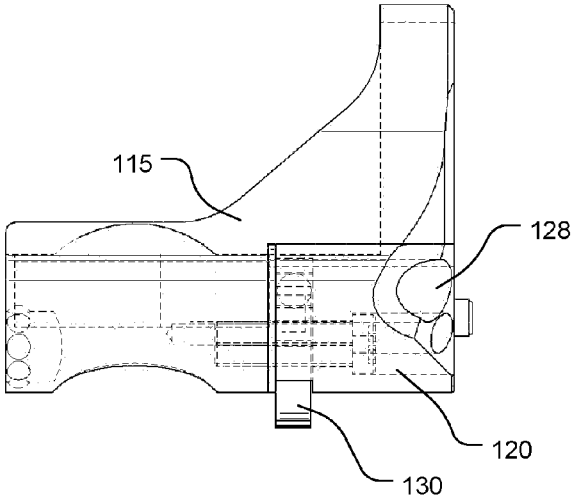
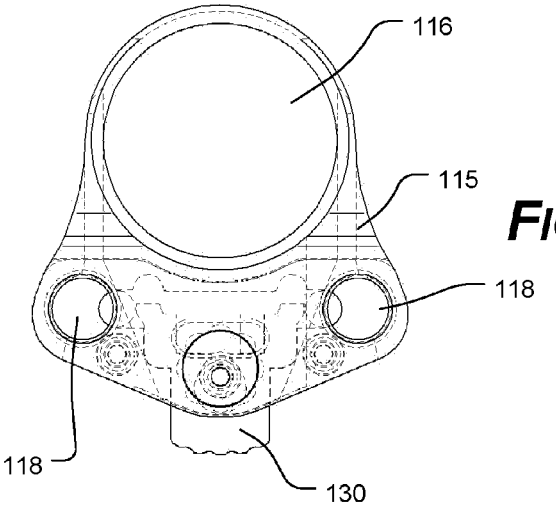
FIG. 12
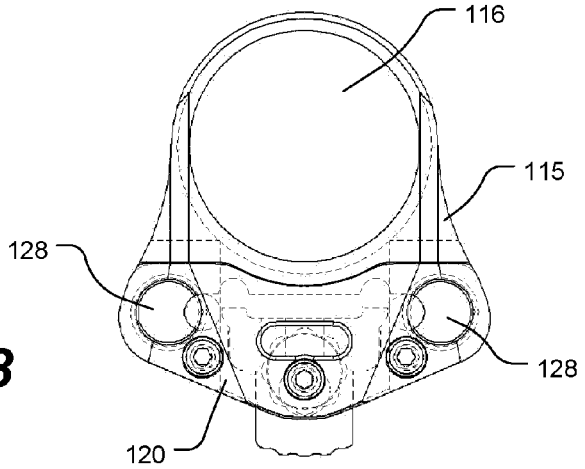
FIG. 13

BOLT-ON COLLAPSIBLE STOCK ASSEMBLY FOR A FIREARM

CROSS-REFERENCE TO RELATED APPLICATIONS

This patent application is a Continuation-in-Part of U.S. patent application Ser. No. 14/639,913, filed Mar. 5, 2015, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of firearms. More specifically, the present disclosure relates to a bolt-on collapsible stock assembly for a firearm.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms utilize a variable position stock 2 that is slidable and lockable at various positions along a buffer tube 5. A typical variable position stock 2 can be locked into a collapsed position, as illustrated in FIG. 1, or locked into a fully extended position, as illustrated in FIG. 2.

As further illustrated in FIGS. 3 and 4, the typical buffer tube 2 includes a capped cylindrical portion having a threaded portion 8 for installation into a firearm receiver. Typically, an endplate 6 and a lock ring 4 are utilized to complete installation of the buffer tube on the receiver. A key protrusion 7 extends from the cylindrical portion 9, typically at the 6 o'clock position. An interior portion of the key protrusion includes a plurality of spaced apart recesses or apertures that interact with a retractable bolt to lock the stock 2 in a desired position relative to the buffer tube 5.

Certain retrofit collapsible stock assemblies are available. These assemblies require use of a shortened, proprietary buffer tube and use of a proprietary bolt carrier, which includes a built-in buffer. In order to install these retrofit collapsible stock assemblies, the upper receiver must be attached to the lower receiver and the existing buffer tube and buffer retainer must be removed from the lower receiver. Next, the proprietary bolt carrier must be inserted through the buffer tube attachment aperture. Then, the proprietary bolt carrier, a proprietary buffer spring, and a proprietary stock adapter are appropriately positioned at the rear of the receiver. Once appropriately positioned, the proprietary buffer tube is then affixed to the lower receiver, via the buffer tube attachment aperture, to secure the components to the receiver.

Finally, the stock is attached to the stock adapter.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, the typical stock can be relatively heavy and cumbersome. The known locking mechanisms used to lock the stock in a desired position along the buffer tube are awkward and difficult to operate.

As discussed above, the current retrofit collapsible stock designs require the removal of the buffer retainer and retainer spring and require the use of a proprietary bolt carrier. Because of the design of the proprietary bolt carrier, once assembled, the upper receiver of the firearm cannot be separated from the lower receiver of the firearm without removing the entire retrofit collapsible stock assembly. Thus, users are not able to separate components of the firearm, in a typical manner, for inspection or cleaning.

Furthermore, the current retrofit collapsible stock designs require use of a large stock adapter. The lower receiver was never designed for use with such a railed, collapsible stock system. Thus, the separate stock adapter adds unnecessary weight and is weaker than the one piece, monolithic stock connector component of the present disclosure.

Additionally, in variations with stock's that are slidably attached, via rails, tubes, or rods, to the firearm receiver, the rails, tubes, or rods typically include cut notches at spaced apart locations along the rails, tubes, or rods for allowing the rails, tubes, or rods (and stock) to be locked into a desired position relative to the receiver. These cut notches reduce the strength and rigidity of the rails, tubes, or rods, thereby weakening the rails, tubes, or rods, making them prone to bending.

The disadvantages and shortcomings of the prior art are overcome by the features and elements of the bolt-on collapsible stock assembly of the present disclosure. The advantages of the present disclosure are preferably attained by providing, in an exemplary, nonlimiting embodiment, a bolt on collapsible stock assembly including a stock connector component and an associated collapsible stock. In various exemplary, nonlimiting embodiments, the stock connector component includes two rod apertures formed therethrough. Typically, the stock connector component includes a stock connector aperture that allows a portion of a buffer tube to be fitted through the stock connector aperture, such that the stock connector component may be attached to the lower receiver via interaction of the buffer tube and the buffer tube attachment aperture of the receiver.

The rod apertures are formed substantially parallel to the longitudinal axis of the stock connector component (and ultimately the receiver of the firearm). In certain exemplary, nonlimiting embodiments, the rod apertures are formed so as to be outside of exterior wall surfaces of the attached receiver. In other exemplary, nonlimiting embodiments, the rod apertures are formed such that mating receiving channels must be formed in adjacent exterior wall surfaces of the attached receiver. In still other exemplary, nonlimiting embodiments, the rod apertures are formed within the stock connector component so as to mate with rod apertures formed within the side walls of the attached receiver.

The rod apertures are formed so as to slidably receive the extension rods that extend from the stock.

The stock assembly comprises a stock, a cheek rest, and two extension rods. The stock comprises an elongate portion of material extending from a top end to a bottom end. A recessed channel is formed in the top end of the stock.

The cheek rest is formed of a substantially inverted "U" or "V" shaped portion of material. The cheek rest is formed so as to be permanently or releasably attached or coupled to the stock proximate the top end. When the cheek rest is attached or coupled to the stock, the space provided between the recessed channel and the cheek rest provides an aperture that allows the buffer tube to freely slide therethrough. The cheek rest is also formed so as to be positioned above and at least partially around the buffer tube that extends along a portion of the receiver.

Typical cheek rest for current retrofit collapsible stock designs leave a large gap between the buffer tube in the stock so that a user is not presented with a cheek weld. In contrast, the cheek rest provides a cheek weld for the user, whether the stock is in a collapsed or extended position.

The extension rods extend from the stock and are positioned so as to be aligned with and slidable within the rod apertures of the stock connector component. In various exemplary embodiments, the extension rods comprise a solid portion of material. Alternatively, the extension rods comprise a hollow or tubular portion of material.

In various exemplary, nonlimiting embodiments, a rod channel is formed along at least a portion of the extension rod. In various exemplary, nonlimiting embodiments, one or more rod dimples/detents are formed along the rod channel. Typically, a rod dimple/detent is formed at each terminating end of the channel and one or more rod dimples/detents are formed along the channel. Each extension rod is a mirror image of the other, such that the number and position of each rod dimple/detent of each extension rod is aligned. In this manner, each rod dimple/detent represents a lockable position of the stock relative to the receiver.

Because the majority of the strength of a rod is in the outer perimeter, by utilizing circular dimples/detents that are cut or pressed into the rod, the rod is more structurally sound than a rod having a large, flat cut across the rod.

By utilizing rod dimples/detents and a rod channel, the strength and integrity of the extension rods is maintained and the problems introduced by cut notches in existing collapsible stocks is circumvented.

A latch assembly, comprising a latch, latch springs, latch elements, and a latch cover, is attached or coupled to the stock connector component. Through interaction of the latch elements and the rod dimples/detents, the stock assembly can be releasably secured at a desired position relative to the stock connector component.

In various exemplary, nonlimiting embodiments, the present disclosure provides a bolt-on collapsible stock assembly for a firearm including at least some of a stock connector component; a stock connector aperture formed through at least a portion of the stock connector component so as to allow at least a portion of a threaded portion of the buffer tube to be received through the stock connector aperture; at least one extension rod aperture formed through the stock connector component, wherein a longitudinal axis of each at least one extension rod aperture is substantially parallel to the longitudinal axis of the receiver, wherein each extension rod aperture is formed so as to slidably receive at least a portion of an extension rod extending from a stock; wherein the stock comprises an elongate portion of material extending from a top end to a bottom end, having a recessed channel formed in the top end of the stock; wherein each extension rod comprises a portion of material that extends from a first end to a second end, wherein a rod channel is formed along at least a portion of each extension rod, and wherein each rod channel includes a rod dimple/detent formed at each terminating end of the rod channel; a latch cover attached or coupled to the stock connector component, wherein the latch cover includes interior side walls defining a latch cover cavity formed so as to receive at least a portion of a latch therein, wherein the latch cover cavity extends to at least one rod aperture formed therethrough, wherein each rod aperture is formed so as to be aligned with a corresponding extension rod aperture; and wherein the latch extends from an engagement portion to a protrusion portion, wherein the latch is movable, along its longitudinal axis, between an engaged position and a disengaged position, wherein when the latch is in the engaged position, the protrusion portion urges at least one latch element into the rod aperture a distance that allows each latch element to seat into the rod dimples/detents of each extension rod, and wherein when the latch is in the disengaged position, the protrusion portion allows the at least one latch element to retract from the rod dimples/detents and into the rod channels of each extension rod.

Accordingly, the present disclosure provides a bolt-on collapsible stock assembly that allows a user to readily adjust the overall length of the stock assembly relative to the receiver, within a determined parameter.

The present disclosure separately and optionally provides a bolt-on collapsible stock assembly that allows a user to readily adjust the overall length of the collapsible stock, using a relatively simple motion that is simplified relative to the current motions necessary to adjust the position of a collapsible stock.

The present disclosure separately and optionally provides a bolt-on collapsible stock assembly that utilizes channels and detents that maintain the strength and integrity of the extension rods and the stock assembly.

The present disclosure separately and optionally provides a bolt-on collapsible stock assembly that provides increased strength and rigidity when compared to known retrofit collapsible stock designs.

The present disclosure separately and optionally provides a bolt-on collapsible stock assembly that can be easily manipulated by a user.

The present disclosure separately and optionally provides a bolt-on collapsible stock assembly that includes a locking feature with a smooth, ball bearing-type mechanism.

The present disclosure separately and optionally provides a bolt-on collapsible stock assembly that includes a strategically positioned locking mechanism that is ambidextrous and can be operated in a single movement/motion as a user grabs the stock and engages the locking mechanism to unlock and extend the stock.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments disclosed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments are disclosed herein; however, it is to be understood that the disclosed embodiments are merely exemplary of what may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of this disclosure will be described in detail, with reference to the following figures, wherein like reference numerals refer to like parts throughout the several views, and wherein:

FIG. 7 illustrates an upper, right, rear perspective view of an exemplary embodiment of a stock connector component, according to the present disclosure;

FIG. 8 illustrates a lower, right, rear perspective view of a stock connector component, according to the present disclosure;

FIG. 11 illustrates a right side view of an exemplary embodiment of a stock connector component, according to the present disclosure;

FIG. 12 illustrates a rear view of an exemplary embodiment of a stock connector component, according to the present disclosure;

FIG. 13 illustrates a front view of an exemplary embodiment of a stock connector component, according to the present disclosure;

DETAILED DESCRIPTION OF THE DISCLOSURE

Figure 1:
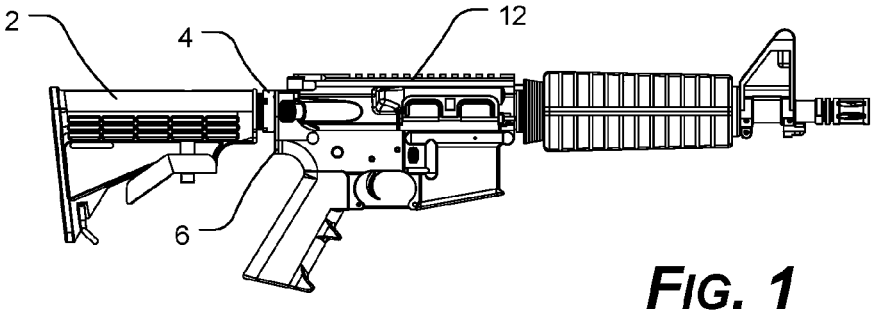
FIG. 1 PRIOR ART
FIG. 1 illustrates a side view of a standard, AR-15 or M4 style rifle having a collapsible stock, shown in a collapsed position relative to a buffer tube.
Figure 2:
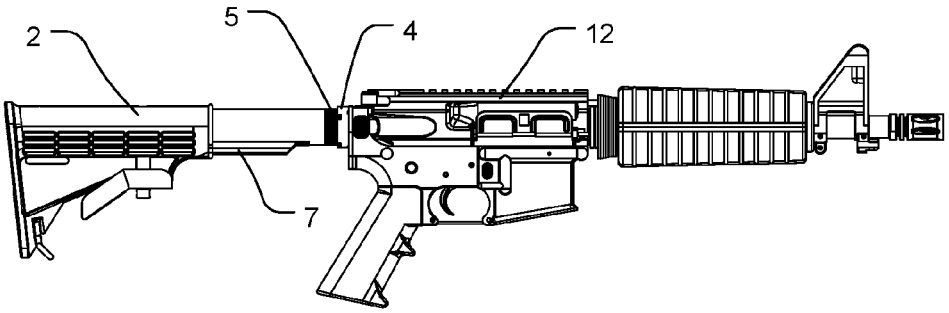
FIG. 2 PRIOR ART
FIG. 2 illustrates a side view of a standard, AR-15 or M4 style rifle having a collapsible stock, shown in an extended position relative to a buffer tube.
Figure 3:
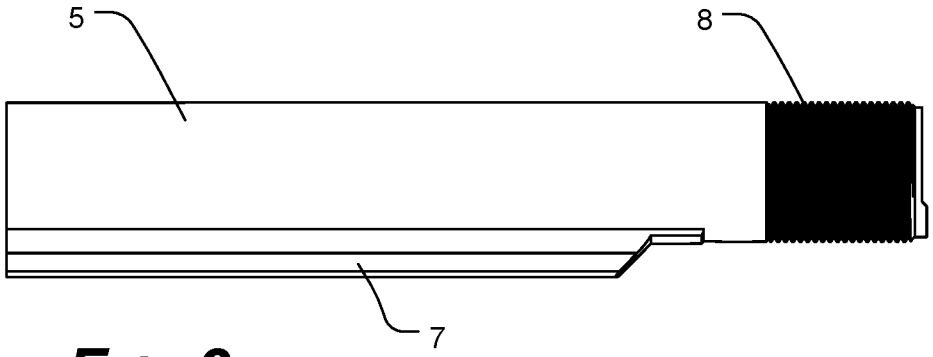
FIG. 3 PRIOR ART
FIG. 3 illustrates a side view of a standard buffer tube.
Figure 4:
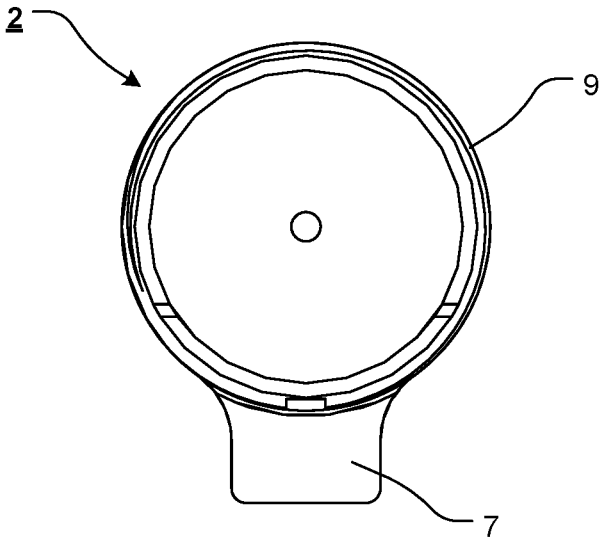
FIG. 4 PRIOR ART
FIG. 4 illustrates a front view of a standard buffer tube.
Figure 5:
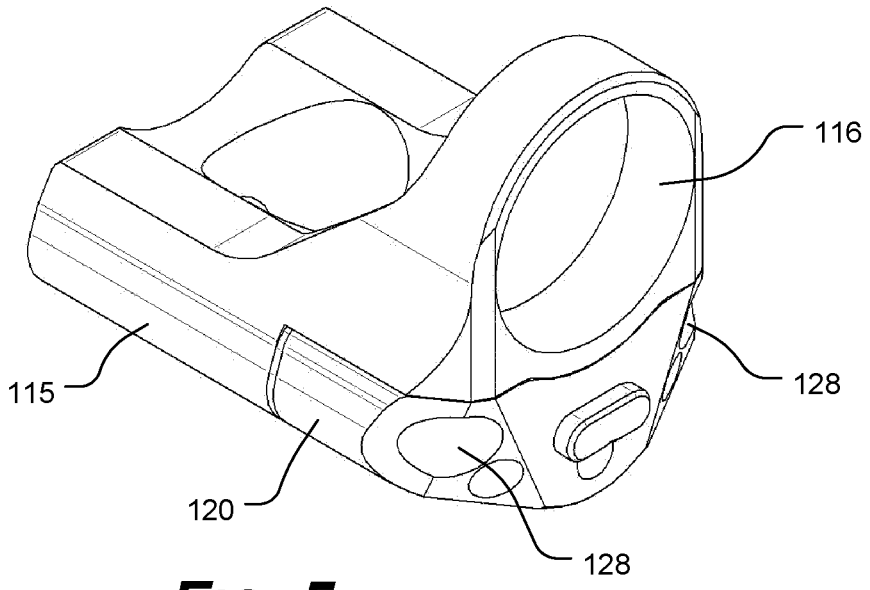
FIG. 5 illustrates an upper, right, front perspective view of an exemplary embodiment of a stock connector component, according to the present disclosure.
Figure 6:
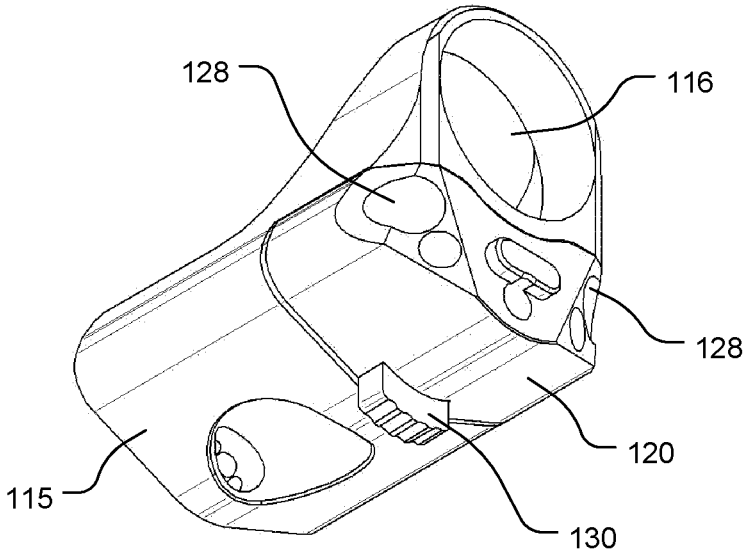
FIG. 6 illustrates a lower, right, front perspective view of an exemplary embodiment of a stock connector component, according to the present disclosure.
Figure 9:
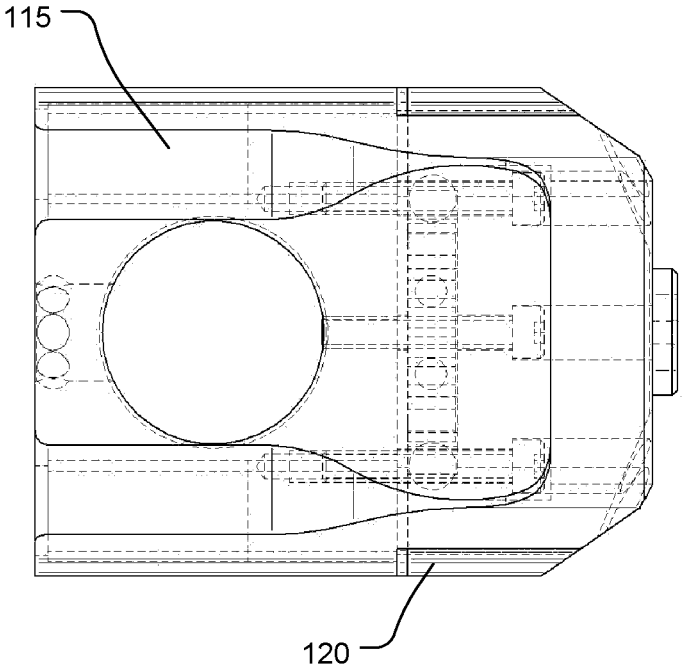
FIG. 9 illustrates a top view of an exemplary embodiment of a stock connector component, according to the present disclosure.
Figure 10:
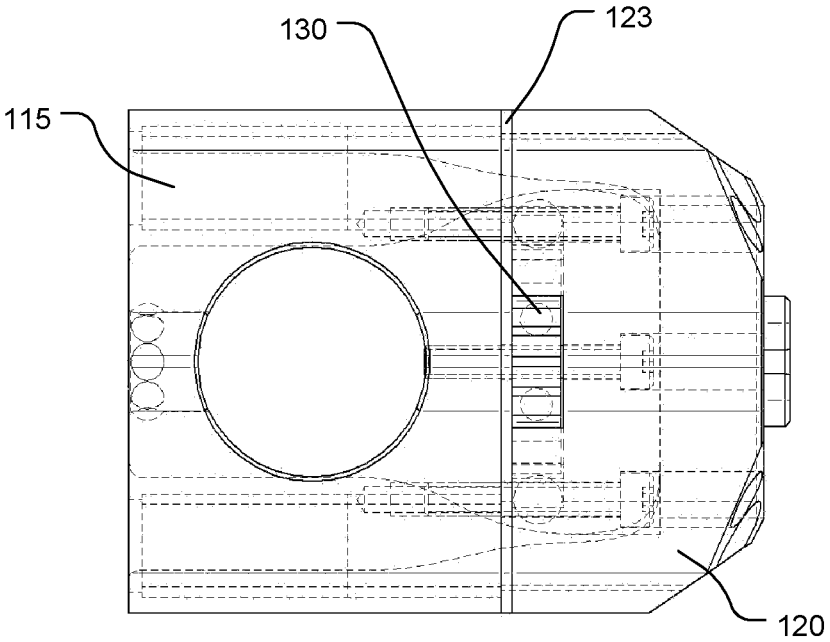
FIG. 10 illustrates a bottom view of an exemplary embodiment of a stock connector component, according to the present disclosure.

For simplicity and clarification, the design factors and operating principles of the bolt-on collapsible stock assembly according to the present disclosure are explained with reference to various exemplary embodiments of a bolt-on collapsible stock assembly. The basic explanation of the design factors and operating principles of the bolt-on collapsible stock assembly is applicable for the understanding, design, and operation of the bolt-on collapsible stock assembly of the present disclosure. It should be appreciated that the bolt-on collapsible stock assembly can be adapted to many applications where a bolt-on collapsible stock assembly can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "receiver", "stock connector component", "collapsible stock", and "firearm" are used for basic explanation and understanding of the operation of the systems, methods, and apparatuses of the present disclosure. Therefore, the terms "receiver", "stock connector component", "collapsible stock", and "firearm" are not to be construed as limiting the systems, methods, and apparatuses of the present disclosure. Thus, for example, the term "receiver" is to be understood to broadly include any upper, lower, or combined receiver for a firearm or other similar handheld or shoulder mounted device or tool.

For simplicity and clarification, the bolt-on collapsible stock assembly of the present disclosure will be described as being used in conjunction with a firearm, such as an AR-15 or M4 style rifle or carbine. However, it should be appreciated that these are merely exemplary embodiments of the bolt-on collapsible stock assembly and are not to be construed as limiting the present disclosure. Thus, the bolt-on collapsible stock assembly of the present disclosure may be utilized in conjunction with any firearm or rifle, such as, for example, an AR-10 style rifle, air rifle, paintball marker, Airsoft rifle, replica rifle, or any other tool, device, or object.

Turning now to the drawing FIGS., as discussed above, FIG. 1-4 illustrate various components of known stocks and buffer tubes. FIGS. 5-48 illustrate certain elements and/or aspects of an exemplary embodiment of the bolt-on collapsible stock assembly 100, according to the present disclosure. In illustrative, non-limiting embodiment(s) of the present disclosure, as illustrated in FIGS. 5-48, the bolt-on collapsible stock assembly 100 comprises a stock connector component 115, a latch cover 120, a latch 130, a cheek rest 150, a stock 160, two extension rods 170 and 170', and optionally a buffer tube 180.

Figure 47:
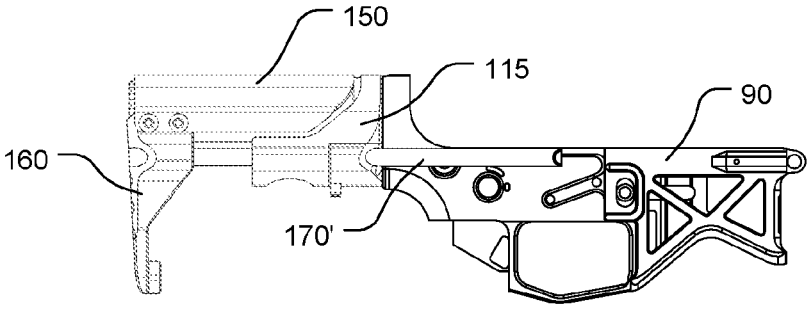
FIG. 47 illustrates a right side view of an exemplary embodiment of a bolt-on collapsible stock assembly assembled together with a buffer tube and an exemplary receiver, wherein the stock assembly is in a fully collapsed position, according to the present disclosure.
Figure 48:
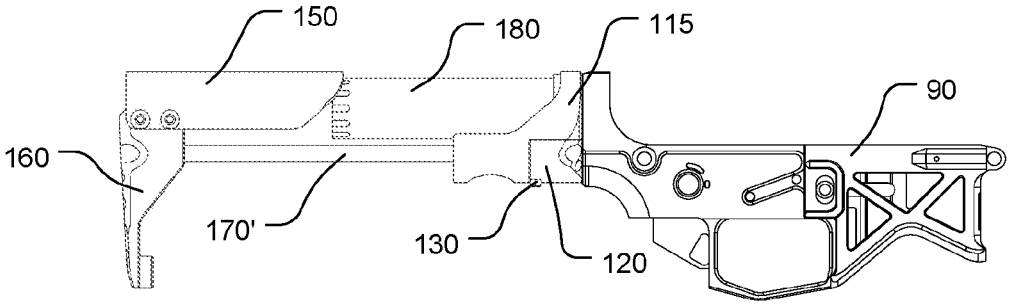
FIG. 48 illustrates a right side view of an exemplary embodiment of a bolt-on collapsible stock assembly assembled together with a buffer tube and an exemplary receiver, wherein the stock assembly is in a fully extended position, according to the present disclosure.

As illustrated in FIGS. 47-48, the bolt-on collapsible stock assembly 100 is illustrated as being attached or coupled, via interaction of the buffer tube 180, to an exemplary lower receiver 90. It should be appreciated that the lower receiver 90 can be a typical lower receiver for a firearm. It should also be appreciated that a more detailed explanation of the lower receiver 90, the standard features and elements of a lower receiver that are not related to the present disclosure, instructions regarding how to assemble the lower receiver 90, and certain other items and/or techniques necessary for the implementation and/or operation of the various exemplary embodiments of the present disclosure are not provided herein because such elements are commercially available and/or such background information will be known to one of ordinary skill in the art. Therefore, it is believed that the level of description provided herein is sufficient to enable one of ordinary skill in the art to understand and practice the present disclosure, as described.

As illustrated, the stock connector component 115 extends rearward, from a stock connector aperture 116. The stock connector aperture 116 is formed so as to allow at least a portion of a threaded portion of the buffer tube 180 to be received through the stock connector aperture 116. The buffer tube 180 includes a shoulder 182, which extends so as not to pass through at least a portion of the stock connector aperture 116. In this manner, the stock connector component 115 may be aligned with the buffer tube aperture of a lower receiver, such as, for example, the exemplary lower receiver 90, as illustrated in FIGS. 47-48, and, attached or coupled to the lower receiver through interaction of external threads of the buffer tube 180 and internal threads of the buffer tube aperture of the lower receiver. As the buffer tube 180 is a threaded onto the lower receiver, the interaction of the stock connector component 115 and the shoulder 182 of the buffer tube 180 secures the stock connector component 115 to the lower receiver.

Two rod apertures 118 are formed through the stock connector component 115, substantially parallel to the longitudinal axis ALR of the bolt-on collapsible stock assembly 100. In certain exemplary, nonlimiting embodiments, the rod apertures 118 are formed so as to be positioned outside at least a portion of the exterior wall surfaces 95 of the lower receiver to which the bolt-on collapsible stock assembly 100 is attached. In other exemplary, nonlimiting embodiments, the rod apertures 118 are formed so as to be positioned at least partially within receiving channels formed in the exterior wall surfaces 95 of the lower receiver to which the bolt-on collapsible stock assembly 100 is attached. In still other exemplary, nonlimiting embodiments, the rod apertures 118 are formed so as to be positioned within the stock connector component 115 and within the side walls of the lower receiver to which the bolt-on collapsible stock assembly 100 is attached. Thus, the rod apertures 118 may extend through the stock connector component 115 and not the lower receiver to which the bolt-on collapsible stock assembly is attached, may optionally extend through the stock connector component 115 and a portion of the exterior wall surfaces 95 of the lower receiver to which the bolt-on collapsible stock assembly 100 is attached, or may optionally extend through the stock connector component 115 and be maintained within the side walls of the lower receiver to which the bolt-on collapsible stock assembly 100 is attached.

The rod apertures 118 are formed so as to slidably receive the extension rods 170 and 170' that extend from the stock 160. In this manner, the extension rods 170 and 170' are repeatably, slidably movable within the rod apertures 118.

Figure 31:
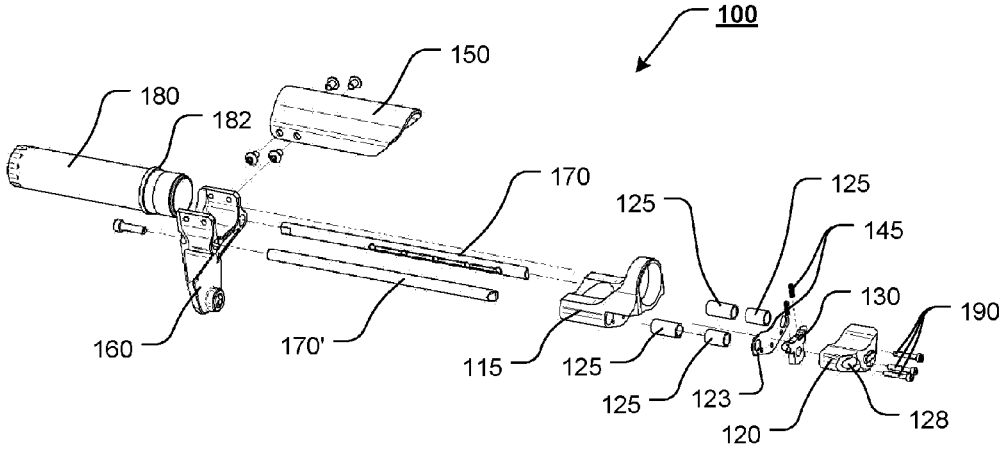
FIG. 31 illustrates an exploded perspective view of the components of an exemplary embodiment of a bolt-on collapsible stock assembly, according to the present disclosure.
Figure 32:
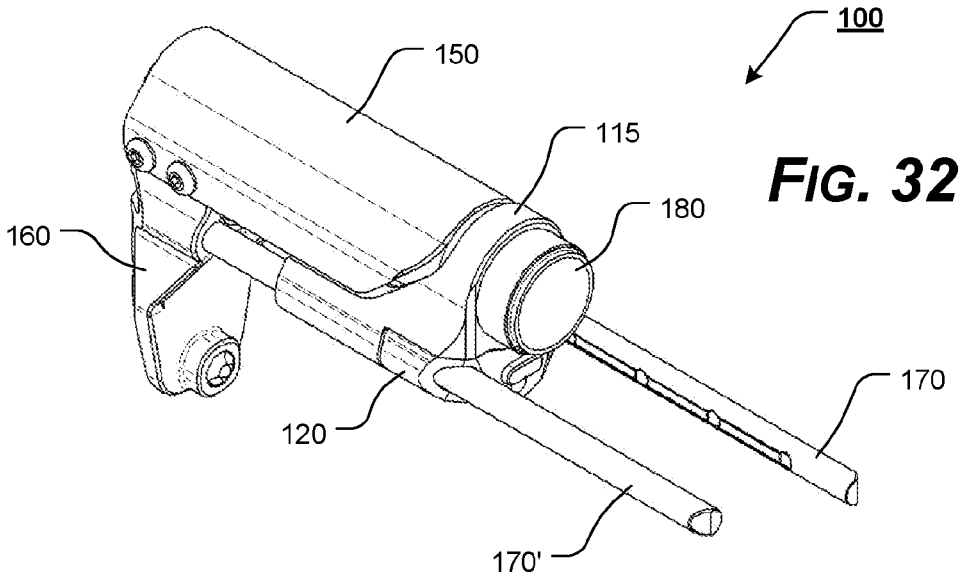
FIG. 32 illustrates an upper, right, front perspective view of an exemplary embodiment of a bolt-on collapsible stock assembly assembled together with a buffer tube, wherein the stock assembly is in a fully collapsed position, according to the present disclosure.
Figure 33:
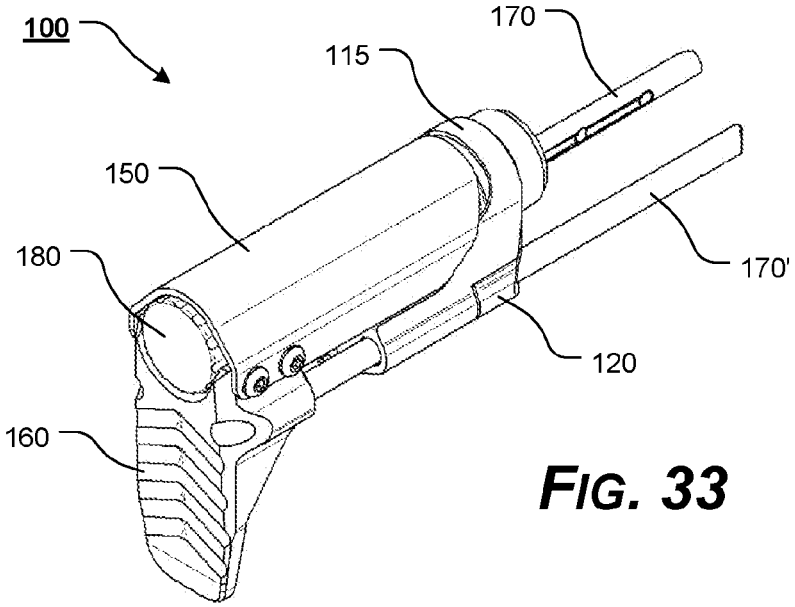
FIG. 33 illustrates an upper, right, rear perspective view of an exemplary embodiment of a bolt-on collapsible stock assembly assembled together with a buffer tube, wherein the stock assembly is in a fully collapsed position, according to the present disclosure.
Figure 34:
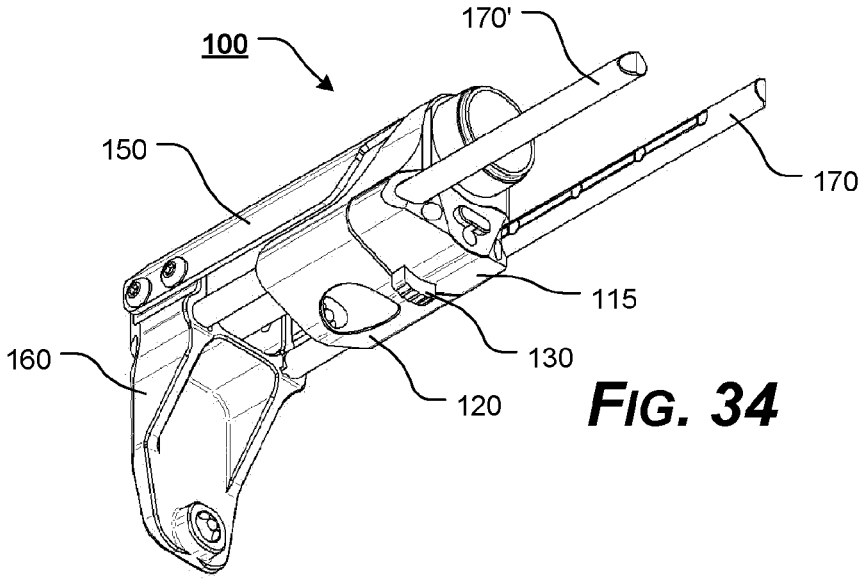
FIG. 34 illustrates a lower, right, front perspective view of an exemplary embodiment of a bolt-on collapsible stock assembly assembled together with a buffer tube, wherein the stock assembly is in a fully collapsed position, according to the present disclosure.
Figure 35:
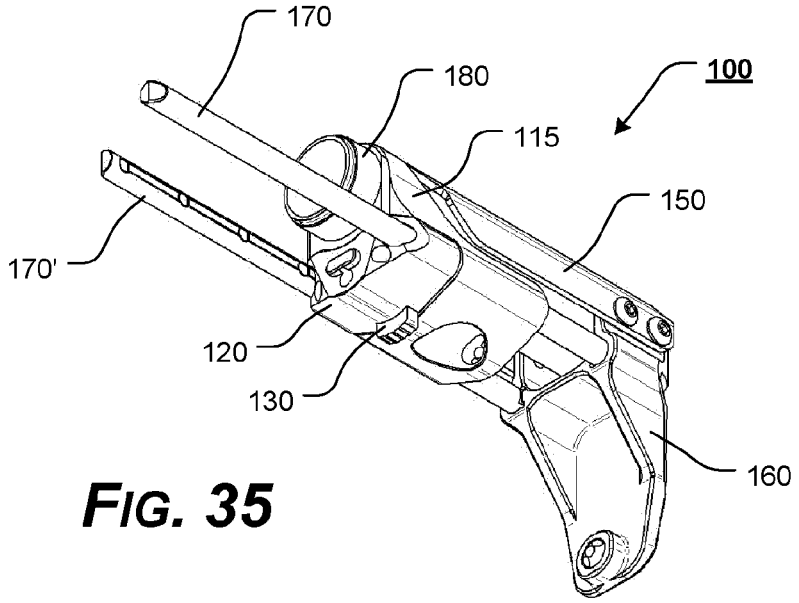
FIG. 35 illustrates a lower, left, front perspective view of an exemplary embodiment of a bolt-on collapsible stock assembly assembled together with a buffer tube, wherein the stock assembly is in a fully collapsed position, according to the present disclosure.
Figure 36:
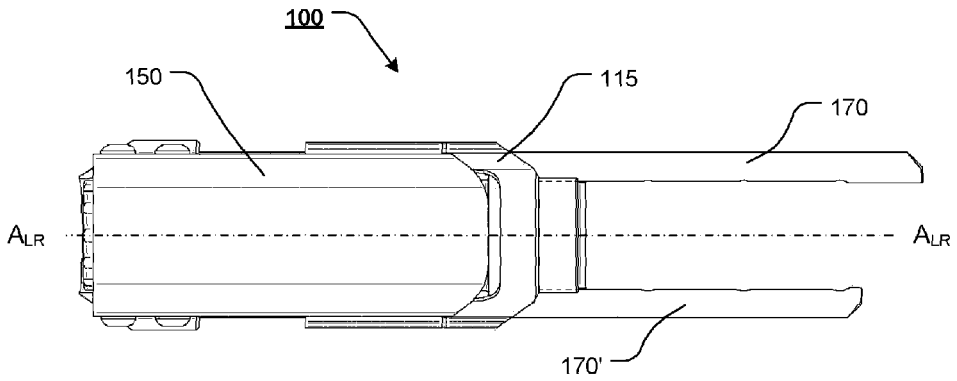
FIG. 36 illustrates a top view of an exemplary embodiment of a bolt-on collapsible stock assembly assembled together with a buffer tube, wherein the stock assembly is in a fully collapsed position, according to the present disclosure.
Figure 37:
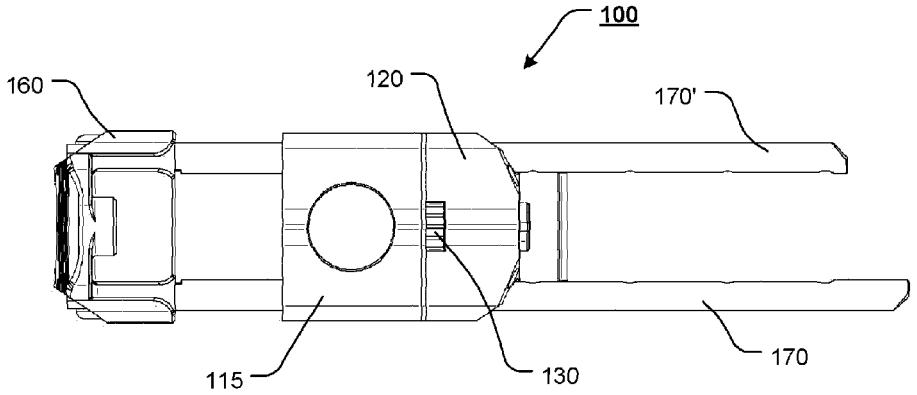
FIG. 37 illustrates a bottom view of an exemplary embodiment of a bolt-on collapsible stock assembly assembled together with a buffer tube, wherein the stock assembly is in a fully collapsed position, according to the present disclosure.
Figure 38:
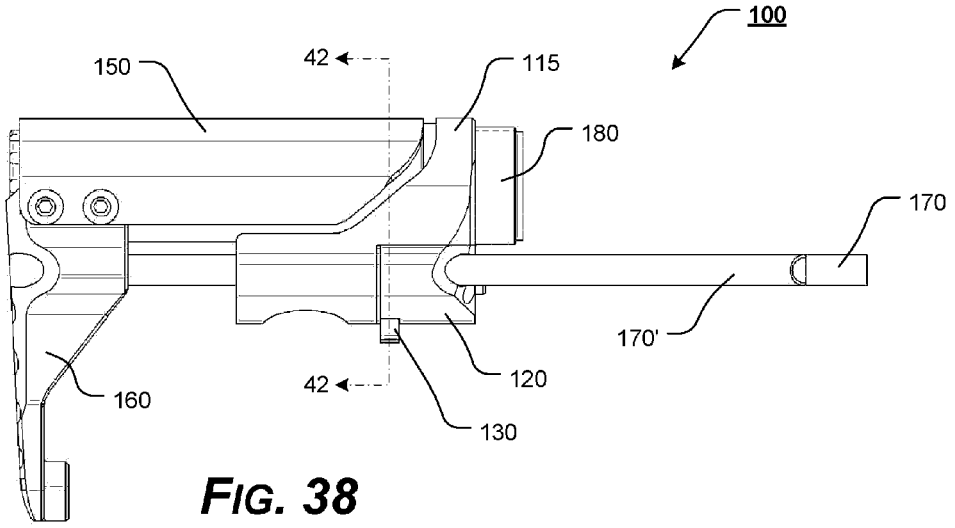
FIG. 38 illustrates a right side view of an exemplary embodiment of a bolt-on collapsible stock assembly assembled together with a buffer tube, wherein the stock assembly is in a fully collapsed position, according to the present disclosure.
Figure 39:
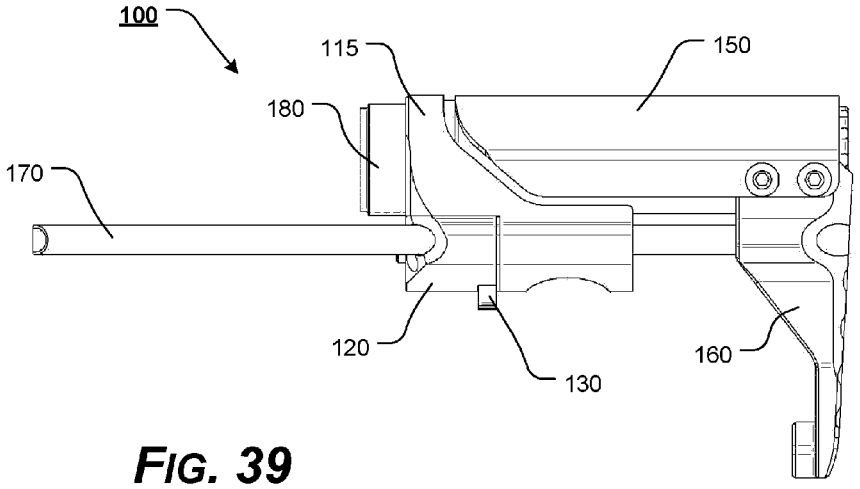
FIG. 39 illustrates a left side view of an exemplary embodiment of a bolt-on collapsible stock assembly assembled together with a buffer tube, wherein the stock assembly is in a fully collapsed position, according to the present disclosure.
Figure 40:
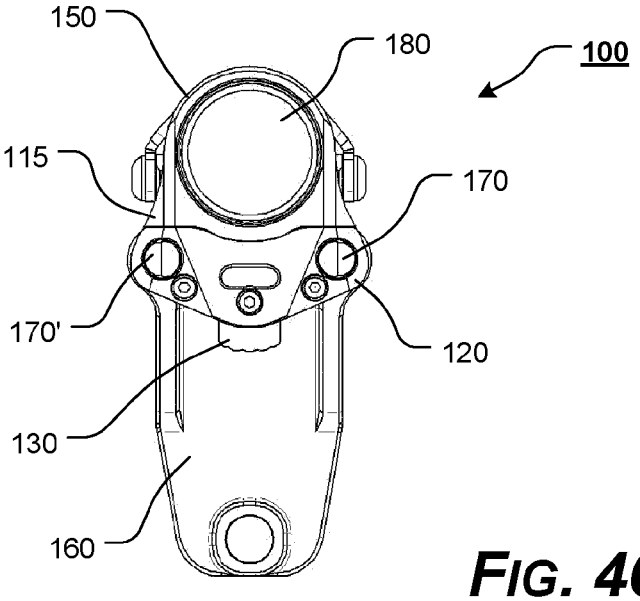
FIG. 40 illustrates a front view of an exemplary embodiment of a bolt-on collapsible stock assembly assembled together with a buffer tube, wherein the stock assembly is in a fully collapsed position, according to the present disclosure.
Figure 41:
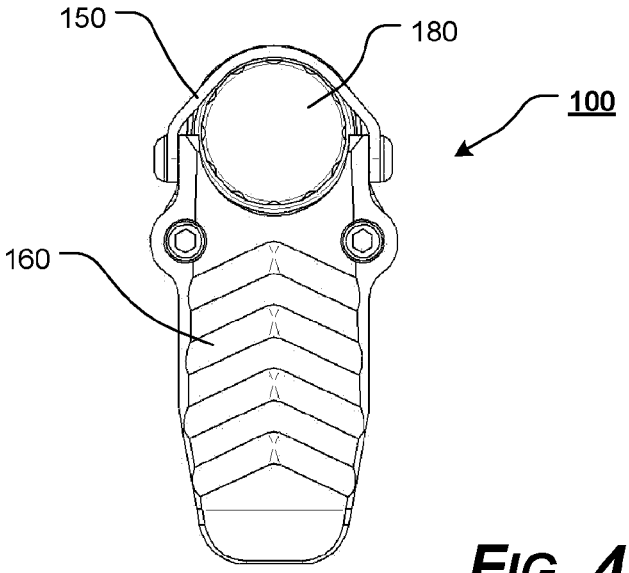
FIG. 41 illustrates a rear view of an exemplary embodiment of a bolt-on collapsible stock assembly assembled together with a buffer tube, wherein the stock assembly is in a fully collapsed position, according to the present disclosure.

In certain exemplary, nonlimiting embodiments, as illustrated in FIG. 31, the rod apertures 118 and/or the rod apertures 128 may be at least partially internally lined with a bushing or liner element 125, comprising a plastic, self-lubricating plastic, or other material to reduce friction between the interior walls of the rod apertures 118 and/or rod apertures 128 and the exterior surface of the extension rods 170 and 170'.

The latch cover 120 is formed so as to be attached or coupled to the stock connector component 115. In various exemplary, nonlimiting embodiments, the latch cover 120 is attached or coupled to the stock connector component 115 via one or more screws 190. Alternatively, depending upon the materials used to create the stock connector component 115 and the latch cover 120, the latch cover 120 may be adhesively or otherwise permanently or removably attached to the stock connector component 115.

Two rod apertures 218 are formed through the latch cover 120, substantially parallel to the longitudinal axis ALR of the bolt-on collapsible stock assembly 100. When the latch cover 120 is attached or coupled to the stock connector component 115, the rod apertures 218 are aligned with the rod apertures 118. In this manner, the extension rods 170 and 170' are repeatably, slidably movable within the rod apertures 118 and the rod apertures 128.

Figure 42:
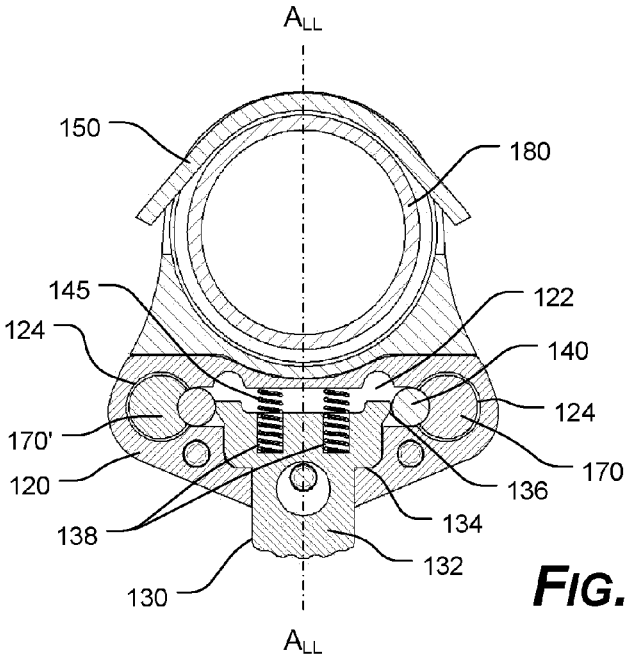
FIG. 42 illustrates a cross-sectional view taken along line 42-42 of the receiver and collapsible buttstock of FIG. 38, wherein the latch is in an engaged, or locked position, according to this invention.
Figure 43:
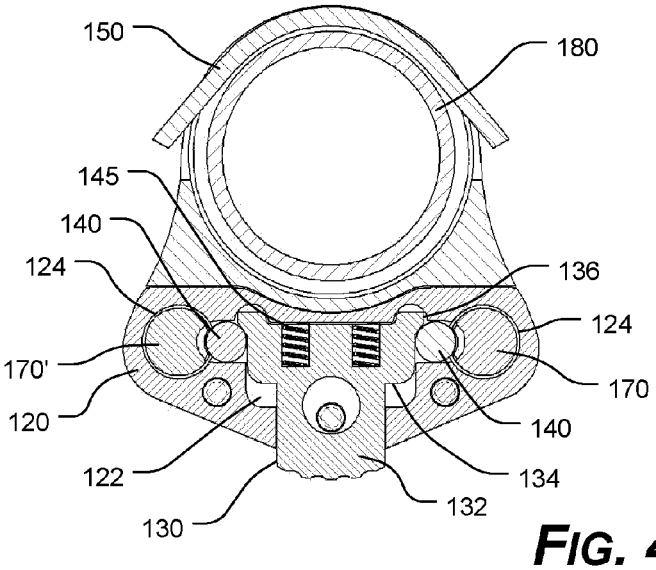
FIG. 43 illustrates a cross-sectional view taken along line 42-42 of the receiver and collapsible buttstock of FIG. 38, wherein the latch is in a disengaged or unlocked position, according to this invention.
Figure 44:
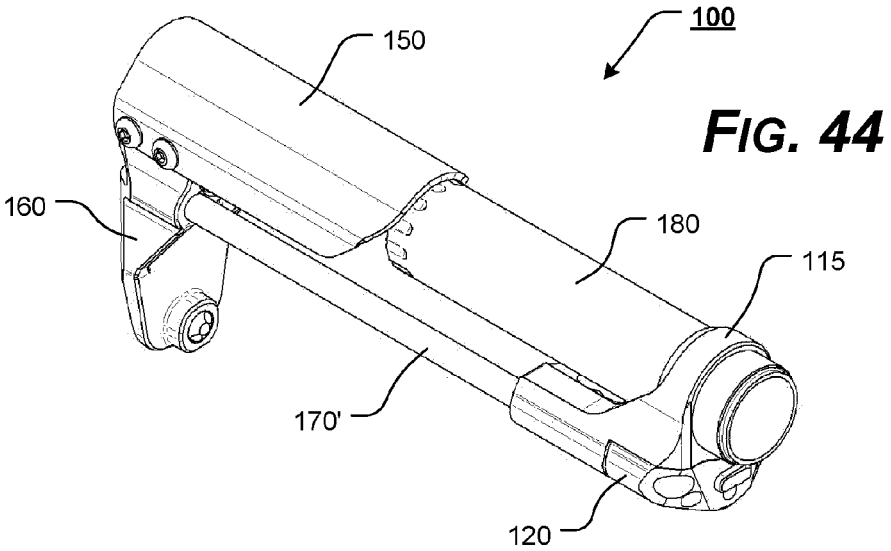
FIG. 44 illustrates an upper, right, front perspective view of an exemplary embodiment of a bolt-on collapsible stock assembly assembled together with a buffer tube, wherein the stock assembly is in a fully extended position, according to the present disclosure.
Figure 45:
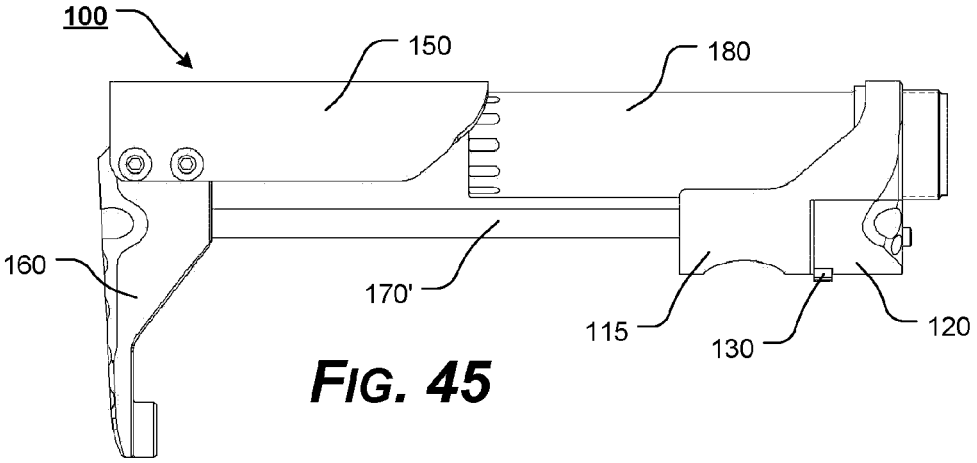
FIG. 45 illustrates a right side view of an exemplary embodiment of a bolt-on collapsible stock assembly assembled together with a buffer tube, wherein the stock assembly is in a fully extended position, according to the present disclosure.
Figure 46:
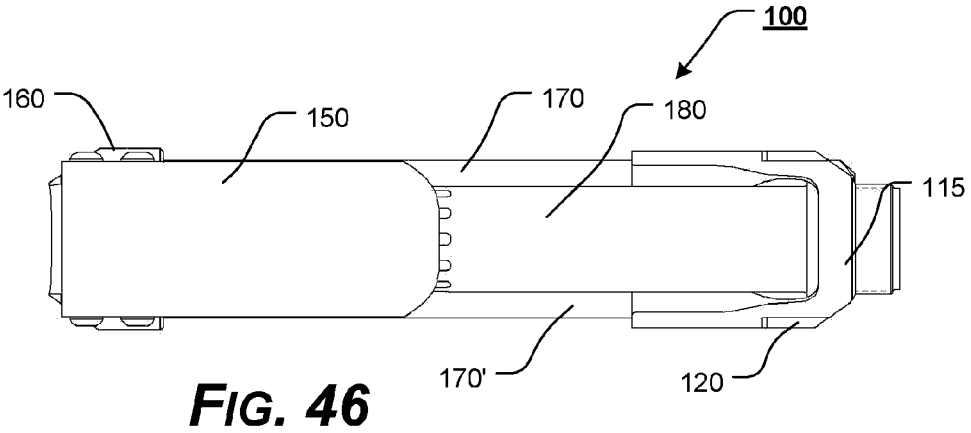
FIG. 46 illustrates a top view of an exemplary embodiment of a bolt-on collapsible stock assembly assembled together with a buffer tube, wherein the stock assembly is in a fully extended position, according to the present disclosure.

As illustrated most clearly in FIGS. 42-43, the latch cover 120 includes interior side walls defining a latch cover cavity 122 formed so as to receive at least a portion of the latch 130 therein. The latch cover cavity 122 includes not only space for at least a portion of the latch 130, but also rod apertures 128 formed therethrough. The rod apertures 128 are formed so as to be aligned with the rod apertures 118 and to slidably receive the extension rods 170 and 170' that extend from the stock 160. In this manner, when the latch cover 120 is attached or coupled to the stock connector component 115, the extension rods 170 and 170' are repeatably, slidably movable within the aligned rod apertures 128 and the rod apertures 118.

One or more gasket element(s) 123 may optionally be positioned between certain of the elements, such as, for example, between a portion of the stock connector component 115 and the latch cover 120. The gasket element(s) 123 may comprise a plastic, self-lubricating plastic, rubber, silicone, metal, carbon fiber, or other material. It should be appreciated that the material used to form the bushing or liner elements 125 and/or the gasket element(s) 123 is a design choice based upon the desired appearance and/or functionality of these elements.

It should also be understood that while the rod apertures 118 and 128 (and the extension rods 170 and 170') are illustrated as having a substantially circular profile, the overall shape and/or profile of the rod apertures 118 and 128 and the extension rods 170 and 170' is a design choice based upon the desired characteristics, functionality, and/or appearance of the rod apertures 118 and 128 and the extension rods 170 and 170'. For example, the rod apertures 118 and 128 and/or the extension rods 170 and 170' may have a substantially circular, square, triangular, rectangular, oblong, "L" shaped, "I" shaped, "C" shaped, "V" shaped, "Z" shaped, "T" shaped, or other profile.

Furthermore, in various exemplary embodiments, the extension rods 170 and 170' may be formed of a solid, hollow, or at least partially hollow portion of material.

Thus, the size and shape of the rod apertures 118 and 128 and the extension rods 170 and 170' may be altered, as desired, so long as at least a portion of the extension rods 170 and 170' are able to be slidably movable within the rod apertures 118 and 128.

Figure 14:
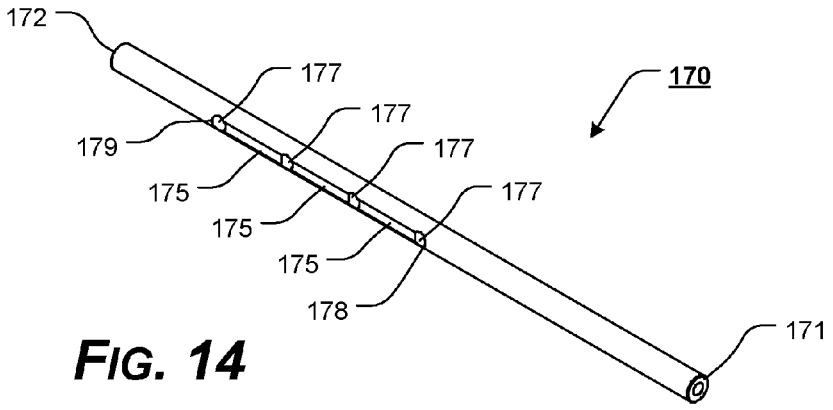
FIG. 14 illustrates a lower, rear perspective view of an exemplary embodiment of an extension rod, according to the present disclosure.
Figure 15:
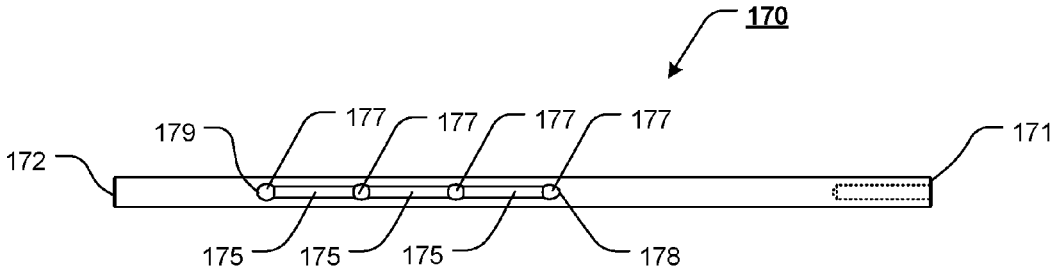
FIG. 15 illustrates a side view of an exemplary embodiment of an extension rod, according to the present disclosure.
Figure 16:
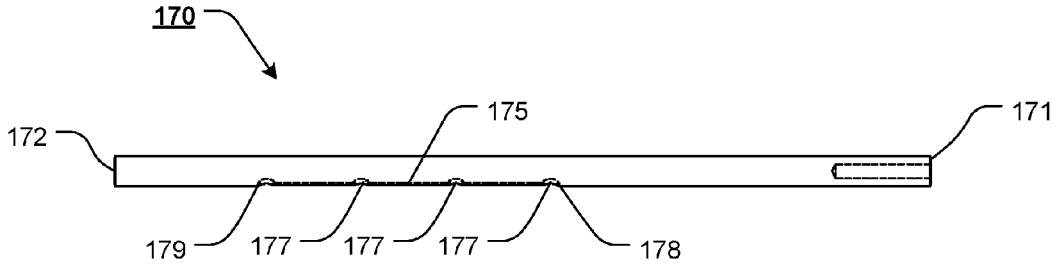
FIG. 16 illustrates a top view of an exemplary embodiment of an extension rod, according to the present disclosure.
Figure 17:
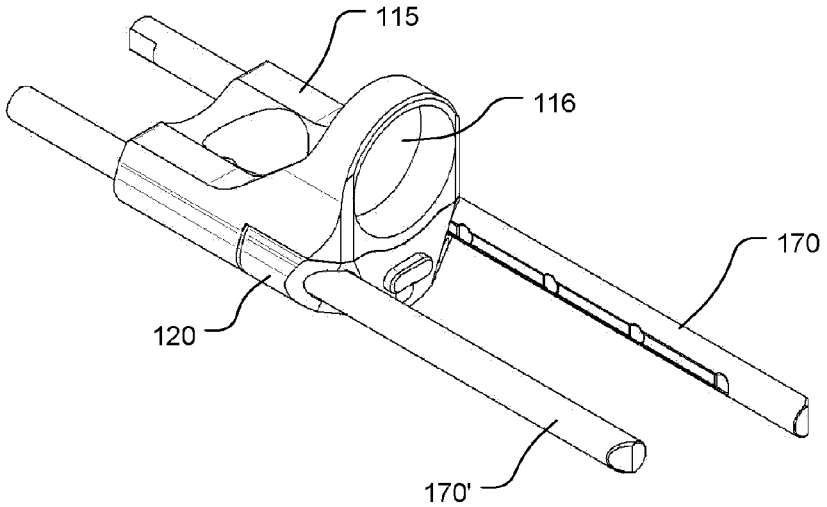
FIG. 17 illustrates an upper, right, front perspective view of an exemplary embodiment of a stock connector component assembled together with two exemplary extension rods, according to the present disclosure.
Figure 18:
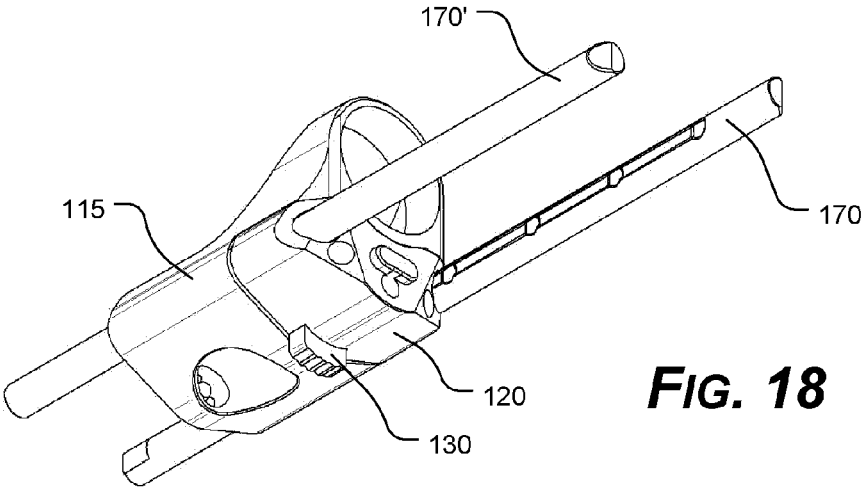
FIG. 18 illustrates a lower, right, front perspective view of an exemplary embodiment of a stock connector component assembled together with two exemplary extension rods, according to the present disclosure.
Figure 19:
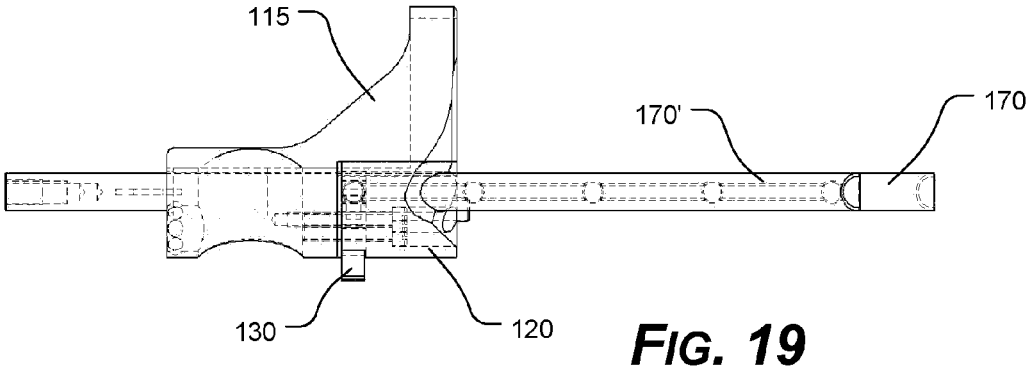
FIG. 19 illustrates a right side view of an exemplary embodiment of a stock connector component assembled together with two exemplary extension rods, according to the present disclosure.

FIGS. 14-16 illustrate a more detailed view of the extension rods 170 and 170'. In various exemplary embodiments, the extension rods 170 and 170' are formed of a substantially cylindrical shaped portion of material that extends from a first end 171 to a second end 172. In various exemplary embodiments, the extension rods 170 and 170' comprise a solid portion of material. Alternatively, the extension rods 170 and 170' comprise a hollow or tubular portion of material.

It should be appreciated that the extension rods 170 and 170' are substantially similar in form and function. However, as illustrated, the extension rod 170 is longer than the extension rod 170'. It should be appreciated that the overall length of the rods 170 and/or 170' is a design choice based upon the desired functionality of the rods 170 and 170'. For example, it may be desired to lengthen or shorten the length of the rod 170 or 170' to avoid or accommodate certain features of the lower receiver to which the bolt-on collapsible stock assembly 100 is to be attached.

In various exemplary, nonlimiting embodiments, a rod channel 175 is formed along at least a portion of the extension rod 170. In various exemplary, nonlimiting embodiments, two or more rod dimples/detents 177 are formed along the rod channel 175. Typically, a rod dimple/detent 177 is formed at each terminating end of the rod channel 175 and one or more rod dimples/detents 177 are formed along the rod channel 175. Each extension rod 170 is a mirror image of the other, such that the number and position of each rod dimple/detent 177 of each extension rod 170 is aligned such that each rod dimple/detent 177 of a first extension rod 170 is paired with an aligned rod dimple/detent of a second extension rod 170. In this manner, each rod dimple/detent 177 represents a lockable position of the stock 160 relative to the lower receiver to which the bolt-on collapsible stock assembly 100 is attached.

In certain exemplary, nonlimiting embodiments, each rod dimple/detent 177 is formed of a semi-spherical recess formed in a portion of the extension rod 170. Each rod dimple/detent 177 may be formed by removing, such as, for example, by machining or cutting, material from the extension rod 170. Alternatively, each rod dimple/detent 177 may be formed by pressing a rod dimple/detent 177 into the extension rod 170. It should be appreciated that the rod channel 175 may be formed in a manner similar to that of the rod dimples/detents 177.

By utilizing rod dimples/detents 177 and a rod channel 175, the strength and integrity of the extension rods 170 and 170' is maintained and the problems introduced by cut notches in existing collapsible stocks is circumvented. Because the majority of the strength of a rod is in the outer perimeter, by utilizing circular dimples/detents that are cut or pressed into the rod, the rod is more structurally sound than a rod having a large, flat cut across the rod.

In still other embodiments, each rod dimple/detent 177 may optionally be formed of a notch or other shaped recess formed in a portion of the extension rod 170.

Figure 49A:
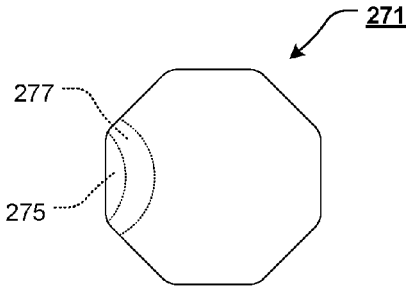
FIG. 49A illustrates a front view of an alternative exemplary embodiment of an extension rod, according to this invention.
Figure 49B:
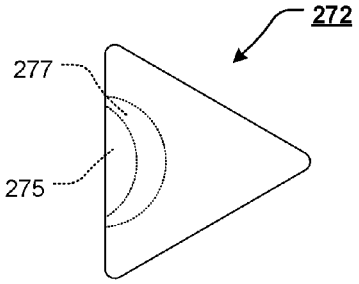
FIG. 49B illustrates a front view of an alternative exemplary embodiment of an extension rod, according to this invention.
Figure 49C:
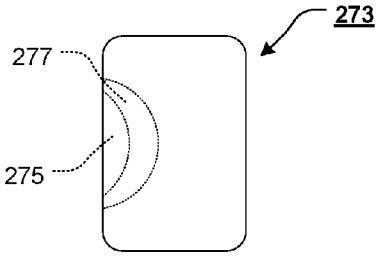
FIG. 49C illustrates a front view of an alternative exemplary embodiment of an extension rod, according to this invention.
Figure 49D:
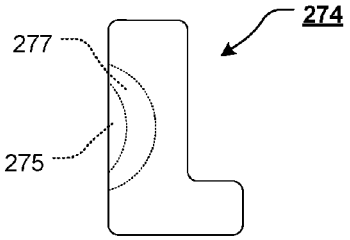
FIG. 49D illustrates a front view of an alternative exemplary embodiment of an extension rod, according to this invention.
Figure 49E:
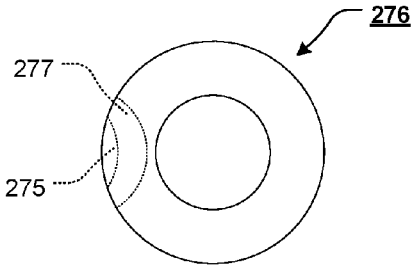
FIG. 49E illustrates a front view of an alternative exemplary embodiment of an extension rod, according to this invention.
Figure 49F:
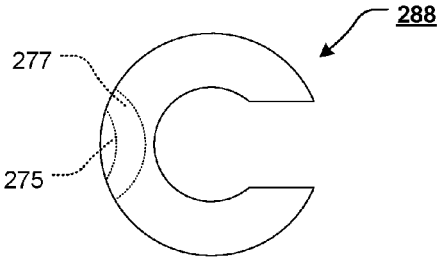
FIG. 49F illustrates a front view of an alternative exemplary embodiment of an extension rod, according to this invention.

As illustrated in FIGS. 49A-49F, the extension rods 170 and 170' may take on a number of profiles and still include structures that correspond to the rod channel 175 and the rod dimples/detents 177. For example, as illustrated in FIG. 49A, the extension rods 271 has a substantially octagonal profile and includes a rod channel 275 and rod dimples/detents 277. As illustrated in FIG. 49B, the extension rods 272 has a substantially triangular profile and includes a rod channel 275 and rod dimples/detents 277; as illustrated in FIG. 49C, the extension rods 273 has a substantially rectangular profile and includes a rod channel 275 and rod dimples/detents 277; as illustrated in FIG. 49D, the extension rods 274 has a substantially "L" shaped profile and includes a rod channel 275 and rod dimples/detents 277; as illustrated in FIG. 49E, the extension rods 276 has a substantially circular, hollow profile and includes a rod channel 275 and rod dimples/detents 277; and as illustrated in FIG.

49F, the extension rods 288 has a substantially C-shaped profile and includes a rod channel 275 and rod dimples/detents 277.

The stock assembly comprises a stock 160, a cheek rest 150, and the extension rods 170 and 170'. The stock 160 comprises an elongate portion of material extending from a top end 161 to a bottom end 162. A recessed channel 165 is formed in the top end of the stock 160. In certain exemplary embodiments, the recessed channel 165 forms a semi-circular channel. Alternatively, the recessed channel 165 may form an alternate shape, primarily as dictated by the outer shape of the buffer tube 180.

As illustrated, the extension rod 170 and the extension rod 170' are attached or coupled to the stock 160 so as to extend from the stock 160. The extension rods 170 and 170' extend from the stock 160 so as to be aligned with and slidable within the rod apertures 118 of the stock connector component 115 and the rod apertures 128 of the latch cover 120.

The cheek rest 150 is formed of a substantially inverted "U" or "V" shaped portion of material that extends from a first end 151 to a second end 152. The cheek rest 150 is formed so as to be permanently or releasably attached or coupled to the stock 160, proximate the first end 151 of the cheek rest 150 and the top end 161 of the stock 160.

The cheek rest 150 is formed so as to be positioned above and at least partially around the buffer tube 180, when the buffer tube 180 is attached to an extends from the lower receiver to which the bolt-on collapsible stock assembly 100 is attached. It should be appreciated that the overall size and shape of the cheek rest 150 is a design choice based upon the desired appearance and/or functionality of the cheek rest 150. Generally, the cheek rest 150 is formed so as to provide a surface for a user to position his or her cheek when the stock 160 is positioned against the user's shoulder. Thus, it should be understood that the exterior size and shape of the cheek rest 150 may be altered to provide a desired cheek weld for a user.

In exemplary embodiments wherein the cheek rest 150 is releasably attached or coupled to the stock 160, alternate shapes and sizes of cheek rest 150 can be provided such that a cheek rest 150 having a desired shape can be selected by a user.

Because of the arcuate shape of the interior of the cheek rest 150, when the cheek rest 150 is attached or coupled to the stock 160, the space provided between the recessed channel 165 and the cheek rest 150 defines an aperture 167, which allows at least a portion of the buffer tube 180 to freely slide therethrough.

As illustrated most clearly in FIGS. 42-43, the latch 130 extends from an engagement portion 132 to a protrusion portion 136. An extension shoulder 134 is disposed between the engagement portion 132 and the protrusion portion 136. At least a portion of the extension shoulder 134 extends laterally, away from the longitudinal axis ALL of the latch 130, beyond a width of the engagement portion 132. At least a portion of the protrusion portion 136 extends laterally, away from the longitudinal axis ALL of the latch 130, beyond a width of the extension shoulder 134.

Figure 20:
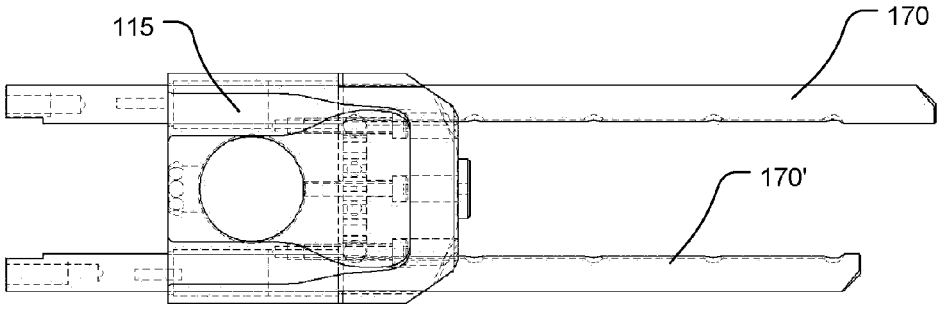
FIG. 20 illustrates a top view of an exemplary embodiment of a stock connector component assembled together with two exemplary extension rods, according to the present disclosure.
Figure 21:
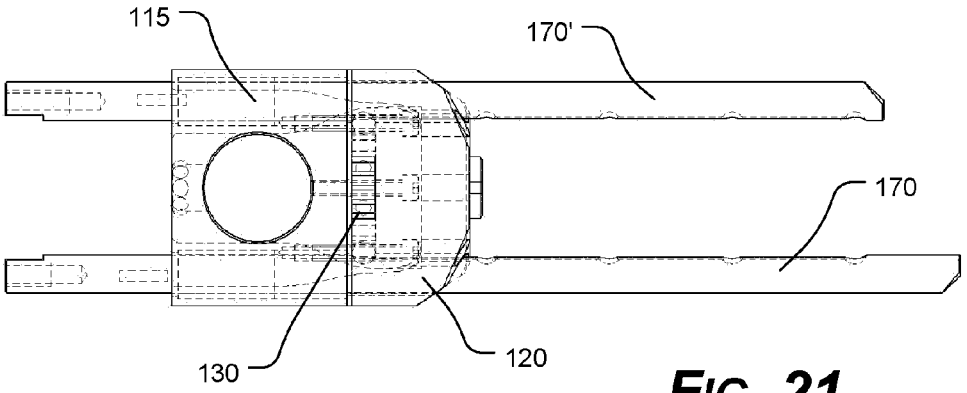
FIG. 21 illustrates a bottom view of an exemplary embodiment of a stock connector component assembled together with two exemplary extension rods, according to the present disclosure.
Figure 22:
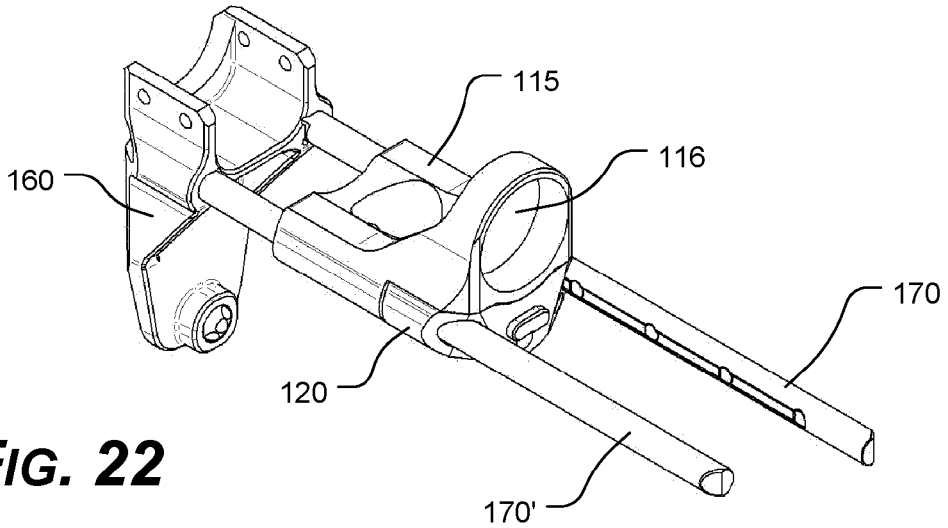
FIG. 22 illustrates an upper, right, front perspective view of an exemplary embodiment of a stock connector component assembled together with two exemplary extension rods, according to the present disclosure.
Figure 23:
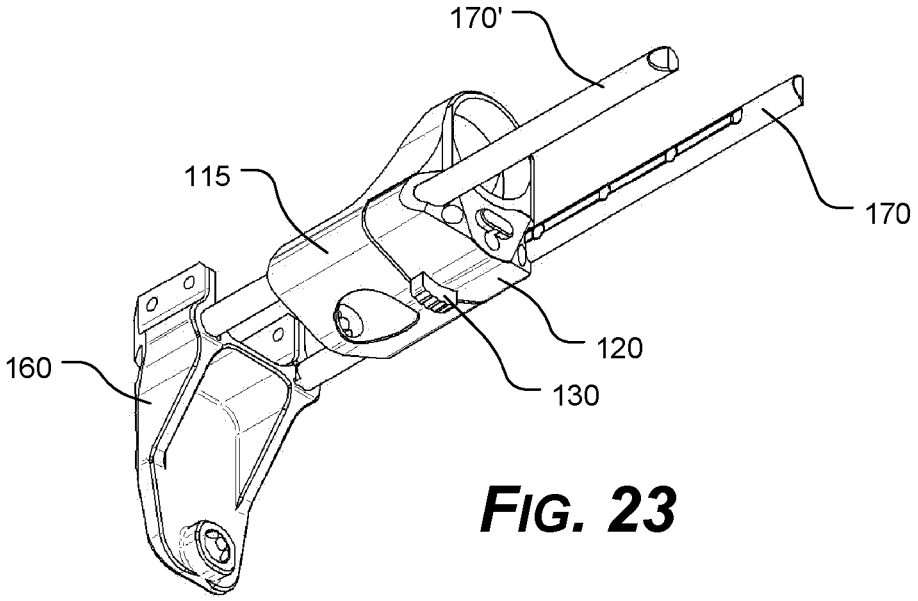
FIG. 23 illustrates a lower, right, front perspective view of an exemplary embodiment of a stock connector component assembled together with two exemplary extension rods and a stock, according to the present disclosure.
Figure 24:
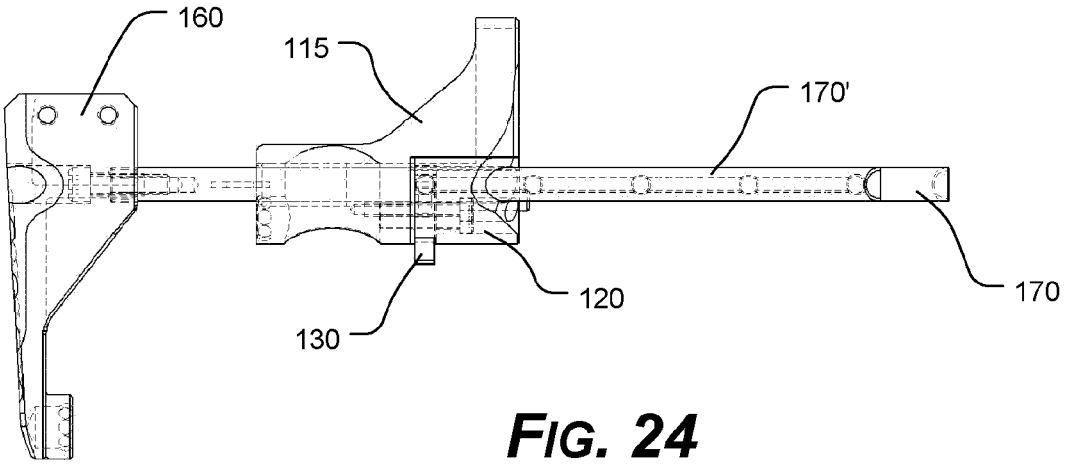
FIG. 24 illustrates a right side view of an exemplary embodiment of a stock connector component assembled together with two exemplary extension rods and a stock, according to the present disclosure.
Figure 25:
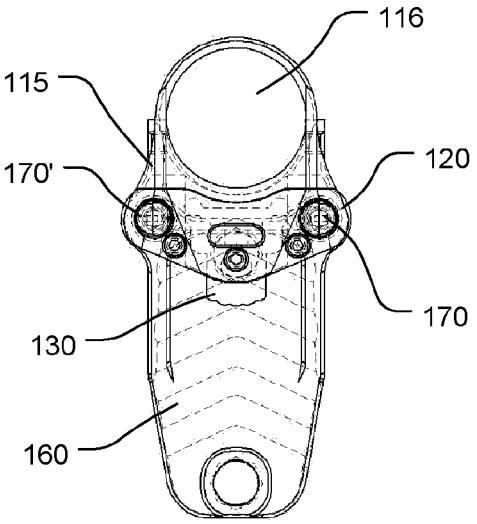
FIG. 25 illustrates a front view of an exemplary embodiment of a stock connector component assembled together with two exemplary extension rods and a stock, according to the present disclosure.
Figure 26:
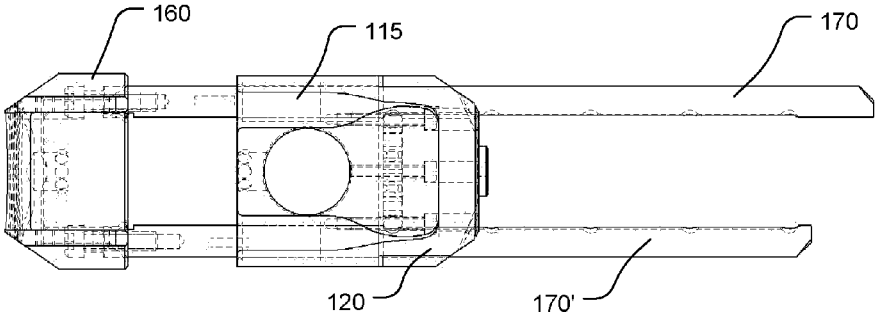
FIG. 26 illustrates a top view of an exemplary embodiment of a stock connector component assembled together with two exemplary extension rods and a stock, according to the present disclosure.
Figure 27:
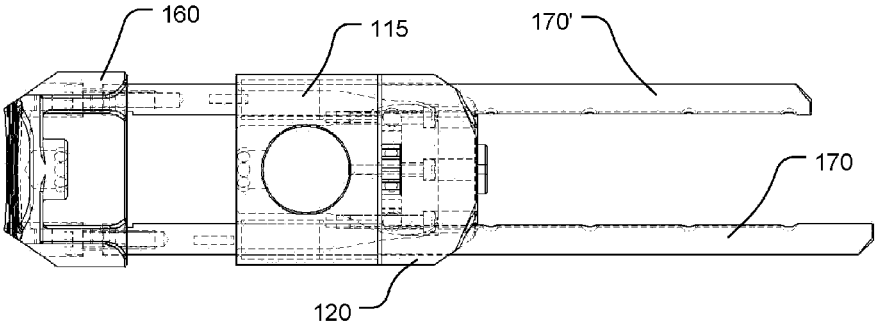
FIG. 27 illustrates a bottom view of an exemplary embodiment of a stock connector component assembled together with two exemplary extension rods and a stock, according to the present disclosure.
Figure 28:
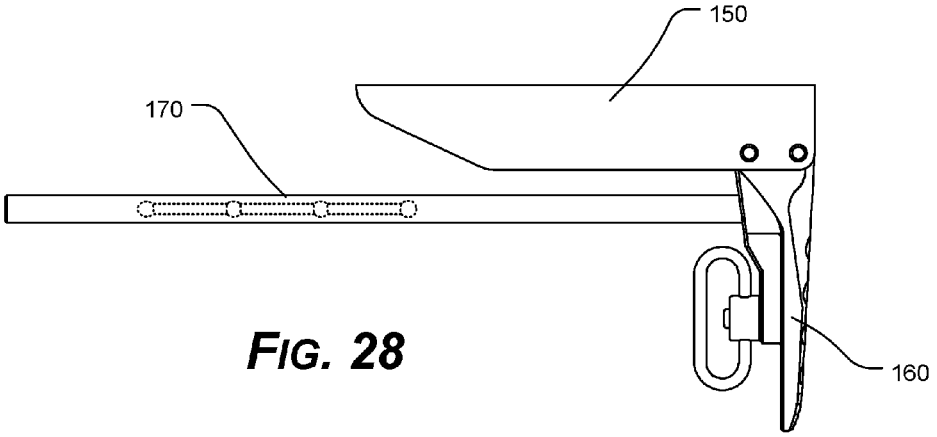
FIG. 28 illustrates a left side view of an exemplary embodiment of a stock assembly, according to the present disclosure.
Figure 29:
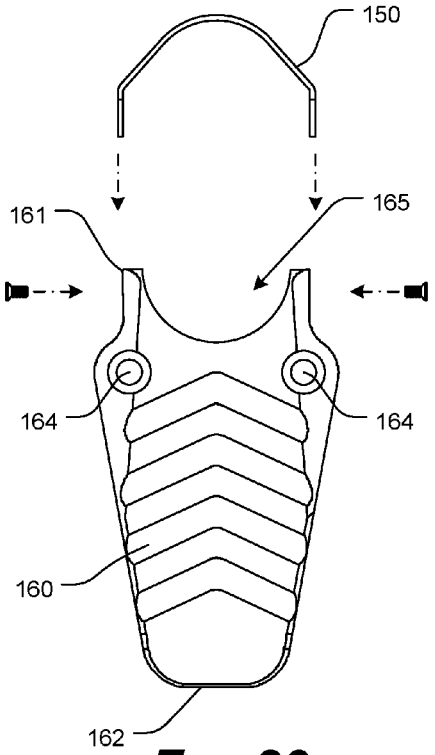
FIG. 29 illustrates a rear, exploded view of an exemplary embodiment of a cheek rest and stock, according to the present disclosure.
Figure 30:
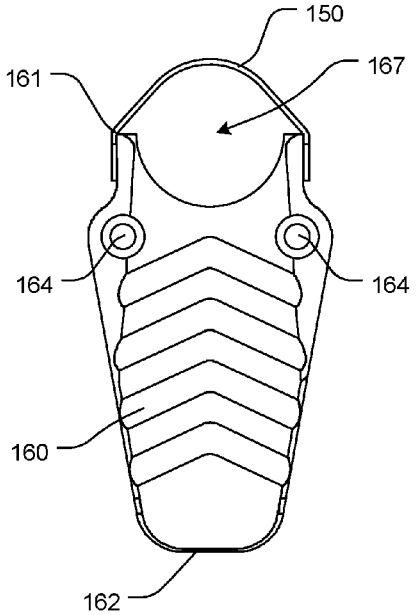
FIG. 30 illustrates a rear view of an exemplary embodiment of an assembled cheek rest and stock, according to the present disclosure.

When the latch 130 is positioned within the latch cover cavity 122, the extension shoulder 134 interacts with side walls of the latch cover cavity 122 to maintain the latch 130 within the latch cover cavity 122. Thus, while maintained within the latch cover cavity 122, at least a portion of the engagement portion 132 protrudes from the latch cover 120 and the latch 130 is movable, along its longitudinal axis ALL. Between an engaged, or locked position, as illustrated in FIG. 20, and a disengaged or unlocked position, as illustrated in FIG. 21.

In various exemplary embodiments, a latch element 140 is positioned proximate either side of the latch cover cavity 122 and maintained between the rod apertures 128 and the protrusion portions 136. In various exemplary, nonlimiting embodiments, each latch element 140 comprises a spherical ball. Alternatively, each of said latch elements 140 may comprise a cylindrical or other portion of material.

By utilizing one or more latch elements 140, a smooth, ball bearing-type action is provided to the lock mechanism. This system provides reduced contact surface friction and smoother and easier manipulation of the components, particularly when compared to a square/rectangular notch.

When the latch 130 is in the disengaged or unlocked position, as illustrated most clearly in FIG. 43, the protrusion portions 136 are urged so as to allow the latch elements 140 to retract further into the latch cover cavity. When the latch 130 is in the engaged or locked position, as illustrated most clearly in FIG. 42, the protrusion portions 136 urge the latch elements 140 into the rod apertures 128.

While the latch assembly is illustrated and described as including latch element(s) 140, it should be appreciated that the latch element(s) 140 may be replaced by one or more protrusion portions, rectangular latches, or the like. Thus, it should be understood that any device, element, or feature able to be at least partially positioned within a rod channel 175 and/or rod dimples/detent 177 may be used as or in place of a latch element 140.

Additionally, while the bolt-on collapsible stock assembly 100 is illustrated as including two latch elements 140, it should be appreciated that the locking mechanism of the bolt-on collapsible stock assembly 100 may only utilize a single latch element 140, positioned proximate a single side of the latch cover cavity 122 and maintained between a single rod aperture 128 and protrusion portion 136.

One or more biasing element receiving recesses 138 may optionally be formed within an upper portion of the latch 130. The biasing element receiving recess(es) 138 allow one or more latch biasing elements 145 to be at least partially positioned therein so as to maintain alignment of the latch biasing elements 145 between the latch 130 and the interior of the latch cover cavity 122.

In various exemplary embodiments, the biasing elements 145 comprise a spring. Alternatively, the biasing element(s) 145 may comprise a single spring or multiple springs, a leaf spring, a resilient portion of material, such as, for example, rubber or silicone, or any other mechanism that can store and return energy in a fashion similar to that of a spring.

In still other exemplary embodiments, the spring biasing element(s) 145 may optionally be replaced with a spring biasing element, such as, for example, a bent piece of spring steel or leaf spring. Alternatively, the spring biasing element(s) 145 may optionally be replaced with a spring biasing element, such as, for example, a resilient block or portion of material.

In certain of these exemplary embodiments, the one or more biasing element receiving recesses 138 are not included in the latch 130.

The biasing elements 145 are positioned between the latch 130 and an interior surface of the latch cover cavity 122, so as to bias the latch 130 to the engaged or locked position, as illustrated in FIG. 42.

The interaction between the latch elements 140 and the rod apertures 128 is such that when the latch 130 is in the disengaged or unlocked position, the latch elements 140 are retracted so as to travel within the rod channels 175 of the extension rods 170 and 170'. However, while in the disengaged or unlocked position, the latch 130 limits the retraction of the latch elements 140 within the latch cover cavity 122 such that the latch elements 140 protrude into the rod apertures 128 a sufficient distance to be maintained within the rod channel 175, thereby limiting the slidable movement of the extension rods 170 and 170' (and the cheek rest 150 and stock 160) relative to the lower receiver to which the bolt-on collapsible stock assembly 100 is attached.

In the engaged or locked position, the latch 130 urges the latch elements 140 further into the rod apertures 128, thereby maintaining each latch element 140 within a rod dimple/detent 177.

Thus, through interaction of the latch elements 140 and the rod dimples/detents 177, the stock assembly can be releasably secured at a desired position relative to the lower receiver to which the bolt-on collapsible stock assembly 100 is attached.

In various exemplary embodiments, various components of the bolt-on collapsible stock assembly 100 are substantially rigid and are formed of aluminum. Alternate materials of construction of the various components of the bolt-on collapsible stock assembly 100 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the bolt-on collapsible stock assembly 100 is a design choice based on the desired appearance and functionality of the bolt-on collapsible stock assembly 100.

It should be appreciated that certain elements of the bolt-on collapsible stock assembly 100 may be formed as an integral unit (such as, for example, the stock 160 and the extension rods 170 and 170'). Alternatively, suitable materials can be used and sections or elements made independently and attached or coupled together, such as by adhesives, welding, screws, rivets, pins, or other fasteners, to form the various elements of the bolt-on collapsible stock assembly 100.

It should also be understood that the overall size and shape of the bolt-on collapsible stock assembly 100, and the various portions thereof, is a design choice based upon the desired functionality and/or appearance of the bolt-on collapsible stock assembly 100.

During use, the stock assembly may initially be presented in a retracted or collapsed position, as illustrated in FIGS. 32-39. In this position, the latch 130 is in the engaged or locked position and the latch elements 140 are positioned within the rod dimples/detents 177 formed at a first terminal end 178 of the rod channel 175. The interaction of the protrusion portions 136, the latch elements 140, and the rod dimples/detents 177 is sufficient to maintain the stock assembly in the collapsed or retracted position even if a withdrawing force is applied to the stock assembly.

When a user desires to extend the stock assembly, the user merely urges the latch 130 upward, along the longitudinal axis ALL, to the disengaged or unlocked position. Because of the convenient position of the engagement portion 132 of the latch 130, intentional manipulation of the latch 130 can be accomplished easily, with the user's finger, thumb, or another surface.

As the latch 130 is urged toward the disengaged or unlocked position, the protrusion portions 136 allow the latch elements 140 to retract into the latch cover cavity 122 a sufficient distance so as to be removed from the rod dimples/detents 177 but maintained within the rod channel 175. Thus, the extension rods 170 and 170' can be slidably withdrawn from the rod apertures 128 and the extension rail apertures 118, a distance permitted by the length of the rod channel 175 and the rod dimple/detent positioned at the second terminal end 179 of the rod channel 175.

In certain exemplary, nonlimiting embodiments, the distance from the first terminal end 178 of the rod channel 175 to the second terminal end 179 of the rod channel 175 is approximately 3 inches. Alternatively, the distance from the terminal ends may be greater or less than 3 inches and may be, for example, 2-10 inches or more.

When the user no longer urges the latch 130 to the unlocked or disengaged position, the spring bias of the latch biasing elements 145 urges the latch 130 toward the engaged or locked position, such that the latch elements 140 may continue to allow slidable movement of the extension rods 170 and 170' until the latch elements 140 reach a rod dimple/detent 177. Upon reaching a rod dimple/detent 177, the spring biasing force of the latch biasing elements 145 urges the latch elements 140 into the rod dimples/detents 177, thereby locking the stock assembly into a given position relative to the lower receiver to which the bolt-on collapsible stock assembly 100 is attached.

FIGS. 47-48 illustrate an exemplary embodiment of a bolt-on collapsible stock assembly 100 assembled together with an exemplary lower receiver 90. FIG. 47 illustrates the stock assembly in a fully collapsed position, while FIG. 48 illustrates the stock assembly in a fully extended position.

While the present disclosure has been described in conjunction with the exemplary embodiments outlined above, the foregoing description of exemplary embodiments of the disclosure, as set forth above, are intended to be illustrative, not limiting and the fundamental disclosure should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A bolt-on collapsible stock assembly, comprising:

a stock connector component;

a stock connector aperture formed through at least a portion of said stock connector component so as to allow at least a portion of a threaded portion of a buffer tube to be received through said stock connector aperture;

at least one extension rod aperture formed through said stock connector component, wherein a longitudinal axis of said at least one extension rod aperture is substantially parallel to a longitudinal axis of a receiver, wherein said at least one extension rod aperture slidably receives at least a portion of an extension rod extending from a stock;

wherein said stock comprises an elongate portion of material extending from a top end to a bottom end, having a recessed channel formed in said top end of said stock;

wherein said at least one extension rod comprises a portion of material that extends from a first end to a second end, wherein a rod channel is formed along at least a portion of said extension rod, and wherein said rod channel includes a rod dimple/detent formed at a terminating end of said rod channel;

a latch cover attached or coupled to said stock connector component, wherein said latch cover includes interior side walls defining a latch cover cavity receiving at least a portion of a latch therein, wherein said latch cover cavity extends to at least one rod aperture formed therethrough, wherein said at least one rod aperture is aligned with a corresponding extension rod aperture; and wherein said latch extends from an engagement portion to a protrusion portion, wherein said latch is movable, along a longitudinal axis of said latch, between an engaged position and a disengaged position, wherein when said latch is in said engaged position, said protrusion portion urges at least one latch element into said rod aperture a distance that allows said at least one latch element to seat into said rod dimple/detent of said extension rod, and wherein when said latch is in said disengaged position, said protrusion portion allows said at least one latch element to retract from said rod dimple/detent and into said rod channels of said at least one extension rod.

2. The bolt-on collapsible stock assembly of claim 1, wherein said at least one rod aperture is internally lined with a plastic, self-lubricating plastic, or other material to reduce friction between an interior wall of said at least one rod apertures and an exterior surface of said at least one extension rod.

3. The bolt-on collapsible stock assembly of claim 1, wherein said at least one extension rod aperture and said at least one extension rod has a substantially circular, square, triangular, rectangular, oblong, "L" shaped, "I" shaped, "C" shaped, "V" shaped, "Z" shaped, "T" shaped profile.

4. The bolt-on collapsible stock assembly of claim 1, further comprising a cheek rest that extends from a first end to a second end, wherein said cheek rest is permanently or releasably attached or coupled to said stock atop said top end of said stock, proximate said first end of said cheek rest, and wherein an aperture is defined between said recessed channel of said stock and an interior surface of said cheek rest, which allows said buffer tube to freely slide therethrough.

5. The bolt-on collapsible stock assembly of claim 4, wherein said cheek rest comprises a substantially inverted "U" or "V" shaped portion of material.

6. The bolt-on collapsible stock assembly of claim 1, wherein said at least one extension rod comprises a solid portion of material.

7. The bolt-on collapsible stock assembly of claim 1, wherein said at least one extension rod comprises a hollow or tubular portion of material.

8. The bolt-on collapsible stock assembly of claim 1, wherein said rod dimple/detent represents a lockable position of said stock relative to said receiver.

9. The bolt-on collapsible stock assembly of claim 1, wherein said at least one latch element comprises a spherical ball, a cylindrical portion of material, a protrusion portion, or a rectangular latch.

10. The bolt-on collapsible stock assembly of claim 1, further comprising at least one biasing element positioned between said latch and an interior surface of said latch cover cavity, so as to bias said latch to said engaged position.

11. A bolt-on collapsible stock assembly, comprising:

a stock connector component having a stock connector aperture formed therethrough, so as to allow at least a portion of a threaded portion of a buffer tube to be received through said stock connector aperture;

at least one extension rod aperture formed through said stock connector component, wherein said at least one extension rod aperture is formed so as to slidably receive an extension rod extending from a stock, such that said extension rod is slidably movable within said at least one extension rod aperture;

wherein said stock comprises a recessed channel formed in an upper portion of said stock;

wherein a rod channel is formed along at least a portion of said at least one extension rod, wherein said rod channel includes a rod dimple/detent formed at a terminating end of said rod channel; and a latch cover attached or coupled to said stock connector component, wherein said latch cover includes interior side walls defining a latch cover cavity, wherein said latch cover cavity extends to at least one rod aperture formed therethrough, wherein said at least one rod aperture is formed so as to be aligned with said at least one extension rod aperture and to slidably receive said at least one extension rod;

wherein a latch extends from an engagement portion to a protrusion portion, wherein said latch is movable, within said latch cover cavity, along a longitudinal axis of said latch, between an engaged position and a disengaged position, wherein when said latch is in said engaged position, said protrusion portion urges at least one latch element into said at least one rod aperture a distance that seats said at least one latch element into said rod dimple/detent of said at least one extension rod, and wherein when said latch is in said disengaged position, said protrusion portion allows said at least one latch element to retract from said rod dimple/detent and into said rod channel of said at least one extension rod.

12. The bolt-on collapsible stock assembly of claim 11, further comprising a cheek rest attached or coupled to said stock, and wherein an aperture is defined between said recessed channel of said stock and an interior surface of said cheek rest, which allows said buffer tube to freely slide therethrough.

13. The bolt-on collapsible stock assembly of claim 11, wherein said at least one rod extension aperture is internally lined with a plastic, self-lubricating plastic, or other material to reduce friction between an interior wall of said at least one rod extension aperture and an exterior surface of said at least one extension rod.

14. The bolt-on collapsible stock assembly of claim 11, wherein said at least one extension rod comprises a solid portion of material.

15. The bolt-on collapsible stock assembly of claim 11, wherein said at least one extension rod comprises a hollow or tubular portion of material.

16. The bolt-on collapsible stock assembly of claim 11, wherein said rod dimple/detent represents a lockable position of said stock relative to said a receiver.

17. The bolt-on collapsible stock assembly of claim 11, wherein said at least one latch element comprises a spherical ball, a cylindrical portion of material, a protrusion portion, or a rectangular latch.

18. The bolt-on collapsible stock assembly of claim 11, further comprising at least one biasing element positioned between said latch and an interior surface of said latch cover cavity, so as to bias said latch to said engaged position.

19. A method for manipulating a collapsible stock attached or coupled to a receiver, wherein said receiver comprises:

a stock connector component having a stock connector aperture formed therethrough, so as to allow at least a portion of a threaded portion of a buffer tube to be received through said stock connector aperture;

at least one extension rod aperture formed through said stock connector component, wherein said at least one extension rod aperture is formed so as to slidably receive an extension rod extending from a stock, such that said extension rod is slidably movable within said at least one extension rod aperture;

wherein said stock comprises a recessed channel formed in an upper portion of said stock;

wherein a rod channel is formed along at least a portion of said at least one extension rod, wherein said rod channel includes a rod dimple/detent formed at a terminating end of said rod channel; and a latch cover attached or coupled to said stock connector component, wherein said latch cover includes interior side walls defining a latch cover cavity, wherein said latch cover cavity extends to at least one rod aperture formed therethrough, wherein said at least one rod aperture is formed so as to be aligned with said at least one extension rod aperture and to slidably receive said at least one extension rod;

wherein a latch extends from an engagement portion to a protrusion portion, wherein said latch is movable, within said latch cover cavity, along a longitudinal axis of said latch, between an engaged position and a disengaged position, wherein when said latch is in said engaged position, said protrusion portion urges at least one latch element into said at least one rod aperture a distance that seats said at least one latch element into said rod dimple/detent of said at least one extension rod, and wherein when said latch is in said disengaged position, said protrusion portion allows said at least one latch element to retract from said rod dimple/detent and into said rod channel of said at least one extension rod;

said method comprising:

urging said latch from said engaged position;

manipulating said stock; and allowing said latch to return to said engaged position.

20. The method of claim 19, wherein said step of allowing said latch to return to said engaged position further comprises allowing at least one biasing element positioned between said latch and an interior surface of said latch cover cavity to bias said latch to said engaged position.

* * * * *